US009816269B2

(12) United States Patent
Glick et al.

(10) Patent No.: US 9,816,269 B2
(45) Date of Patent: Nov. 14, 2017

(54) CONNECTOR ARRANGEMENT FOR A WALL PANEL SYSTEM

(71) Applicant: Haworth, Inc., Holland, MI (US)

(72) Inventors: Kristen Glick, Holland, MI (US); Jason DeWeerd, Allegan, MI (US); Robert Clare Wayner, Holland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 14/933,304

(22) Filed: Nov. 5, 2015

(65) Prior Publication Data

US 2016/0130808 A1 May 12, 2016

Related U.S. Application Data

(63) Continuation of application No. 14/493,915, filed on Sep. 23, 2014, now Pat. No. 9,206,605, which is a continuation of application No. 13/228,868, filed on Sep. 9, 2011, now Pat. No. 8,844,222, which is a continuation of application No. 11/982,900, filed on Nov. 6, 2007, now Pat. No. 8,015,767.

(60) Provisional application No. 60/857,095, filed on Nov. 6, 2006.

(51) Int. Cl.

| | |
|---|---|
| ***E04B 5/00*** | (2006.01) |
| ***E04B 7/00*** | (2006.01) |
| ***E04B 2/74*** | (2006.01) |
| ***E04B 2/56*** | (2006.01) |
| ***E04C 2/34*** | (2006.01) |
| ***E04B 2/76*** | (2006.01) |

(52) U.S. Cl.

CPC ..... *E04B 2/7407* (2013.01); *E04B 2/56* (2013.01); *E04B 2/7425* (2013.01); *E04B 2/76* (2013.01); *E04C 2/34* (2013.01); *E04B 2002/742* (2013.01); *E04B 2002/749* (2013.01); *E04B 2002/7487* (2013.01)

(58) Field of Classification Search

CPC .. E04B 2002/7483; E04B 2/7425; E04B 2/56; E04B 2002/742; E04B 2002/7487; E04B 2002/749; E04C 2/34

USPC ..... 52/239, 79.1, 220.7, 238.1, 241–243

See application file for complete search history.

(56) References Cited

U.S. PATENT DOCUMENTS

| | | | | |
|---|---|---|---|---|
| 4,147,198 | A | 4/1979 | Ytter | |
| 4,458,461 | A | 7/1984 | Holley | |
| 4,535,577 | A | 8/1985 | Tenser et al. | |
| 4,689,930 | A * | 9/1987 | Menchetti | E04B 2/7409 52/275 |

(Continued)

FOREIGN PATENT DOCUMENTS

| | | |
|---|---|---|
| EP | 0293240 | 11/1988 |

*Primary Examiner* — Brian D Mattei

(74) *Attorney, Agent, or Firm* — Warner Norcross & Judd LLP

(57) ABSTRACT

A connector arrangement for a wall panel system is provided which includes connector blocks that join serially-adjacent wall panel frames together in proper alignment with each other. These corner blocks also are matable with a system of spacer strips, light block strips, single-side trim covers and multi-side trim covers which enclose the connector blocks and connector structure. A corner spline arrangement is also provided between adjacent trim covers which spline extends vertically and defines a closed corner, right-angled corner between the interconnected trim covers.

18 Claims, 20 Drawing Sheets

(56) References Cited

U.S. PATENT DOCUMENTS

| | | | | |
|---|---|---|---|---|
| 4,698,946 | A | 10/1987 | Wendt | |
| 4,907,783 | A | 3/1990 | Fisk et al. | |
| 5,625,991 | A | 5/1997 | Sturrus | |
| 5,642,593 | A | 7/1997 | Shieh | |
| 5,682,719 | A | 11/1997 | Huang | |
| 6,167,665 | B1 | 1/2001 | Dame et al. | |
| 6,389,773 | B1 | 5/2002 | Reuter et al. | |
| 6,393,783 | B2 | 5/2002 | Emaus et al. | |
| 6,415,567 | B1 | 7/2002 | Mead et al. | |
| 6,442,909 | B2 | 9/2002 | Waalkes et al. | |
| 6,592,194 | B2 * | 7/2003 | Lininger | A47B 83/001 312/257.1 |
| 6,729,085 | B2 * | 5/2004 | Newhouse | B25B 5/003 52/239 |
| 6,820,388 | B2 | 11/2004 | Newhouse et al. | |
| 6,848,230 | B2 | 2/2005 | Kopish | |
| 6,964,138 | B2 | 11/2005 | Carroll et al. | |
| 2001/0029713 | A1 | 10/2001 | Beck et al. | |
| 2002/0108330 | A1 | 8/2002 | Yu et al. | |
| 2003/0213193 | A1 | 11/2003 | Carroll et al. | |
| 2004/0177573 | A1 | 9/2004 | Newhouse et al. | |
| 2006/0059806 | A1 | 3/2006 | Gosling et al. | |
| 2006/0236625 | A1 | 10/2006 | MacDonald et al. | |
| 2008/0104907 | A1 | 5/2008 | Glick et al. | |
| 2008/0104922 | A1 | 5/2008 | Glick et al. | |
| 2009/0001859 | A1 | 1/2009 | Compton et al. | |

* cited by examiner

CONNECTOR ARRANGEMENT FOR A WALL PANEL SYSTEM

CROSS REFERENCE TO RELATED APPLICATION

This application is a continuation of U.S. application Ser. No. 14/493,915, filed Sep. 23, 2014, which is a continuation of U.S. application Ser. No. 13/228,868, filed Sep. 9, 2011 (now U.S. Pat. No. 8,844,222), which is a continuation of U.S. application Ser. No. 11/082,900, filed Nov. 6, 2007 (now U.S. Pat. No. 8,015,767), which claims the benefit of U.S. Provisional Application No. 60/857,095, filed Nov. 6, 2006, which is incorporated herein by reference in its entirety.

FIELD OF THE INVENTION

The invention relates to a universal connector arrangement for a wall panel system, and more particularly, to a connector arrangement for joining multiple wall panel frames together in various multi-way connections.

BACKGROUND OF THE INVENTION

Interior wall systems formed from a plurality of upright interior panels which are typically serially joined in aligned and/or transverse relationship are conventionally utilized in offices and the like to divide large open areas into smaller work spaces. The upright wall panels are typically manufactured in the factory with final assembly occurring at the job site, which final assembly typically involves attachment of removable cover pads to opposite sides of the upright panel frame, and attachment of various trim pieces along the edges, such as a top cap along the top edge of the panel and side trim covers at the end-of-run position and at corner connections. Interior space-dividing wall systems of the type described above generally permit panels to be joined in right-angled relationship to one another, such as L-shaped or T-shaped configurations, although the perpendicularly joined panels are typically joined at the panel edges in multi-way connections, such as two-way, three-way or four-way connections.

It is an object of the invention to provide an improved connector arrangement for joining wall panel, frames together and aesthetically covering the connector structure with trim coverings.

More particularly, the invention relates to a universal connector arrangement comprising tubular corner blocks which interconnect between serially adjacent ends of wall panel frames to join the panel frames together in multi-way corner connections. These corner blocks fundamentally join the panel frames together in proper alignment with each other. These corner blocks further are adapted to readily mount various trim coverings thereon depending on the specific configuration of wall panels, such as with respect to the orientation of the wall panels in a two-way, three-way or four-way connection.

More particularly, the corner blocks include appropriate slots for mounting of single-side trim covers thereto in suspended relation which are positioned so as to maintain proper alignment with adjacent trim covers and also the cover tiles mounted to the panel frames. The corner blocks further include a spacer arrangement which is selectively positioned between the corner blocks and interconnected panel frames to ensure that the trim covers are in flush alignment in the vertical plane defined across the faces of the cover tiles, which spacers are also removable from unused locations on the corner blocks to permit the mounting of the trim covers in flush alignment with the cover tiles.

Still further, the trim covers have an improved configuration which permits covering of the corner blocks when wall panels are interconnected together in a multi-way connection, which panels have different heights relative to each other. The improved trim cover arrangement is readily adaptable to this variable-height frame configuration. In such a case, the single-side trim covers are adapted to be interconnected in a right-angle orientation through a corner spline which interconnects the trim covers together while defining a closed corner.

These features provide an improved connector arrangement for the wall panel system so as to overcome disadvantages with the prior art and provide an aesthetically pleasing system of trim covers that are maintained in precise alignment with each other.

Other objects and purposes of the invention, and variations thereof, will be apparent upon reading the following specification and inspecting the accompanying drawings.

Figure 1:
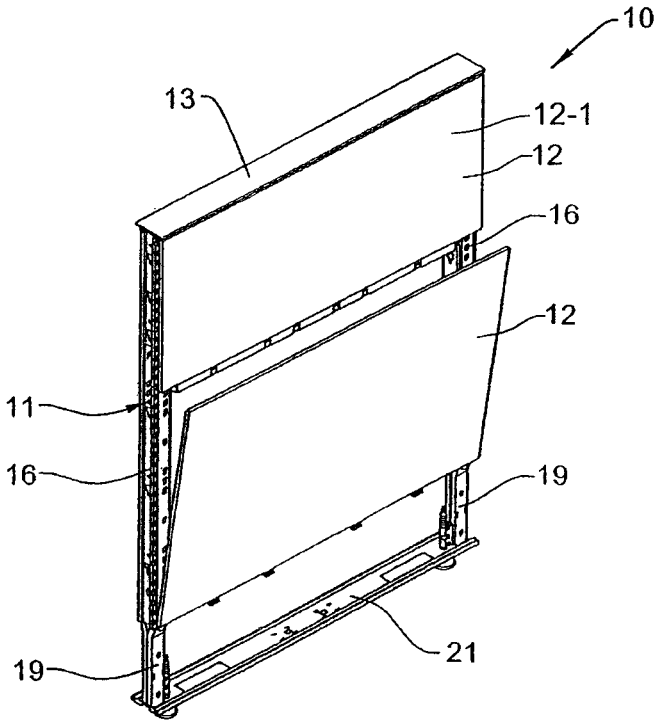
FIG. 1 is a perspective view of an upright wall panel of this invention.

Certain terminology will be used in the following description for convenience and reference only, and will not be limiting. For example, the words "upwardly", "downwardly", "rightwardly" and "leftwardly" will refer to directions in the drawings to which reference is made. The words "upper" and "lower" will also refer to portions of the panel when in its normal vertically-oriented position of use. The words "inward" and "outward" will refer to directions toward and away from, respectively, the geometric center of the panel and designated parts and assemblies associated therewith. Said terminology will include the words specifically mentioned, derivatives thereof, and words of similar import.

DETAILED DESCRIPTION

Referring to FIG. 1, there is illustrated an upright space-dividing wall panel 10 of the type used for creating an upright wall system, which system involves joinder of several such panels in adjacent aligned and/or transverse relationship for at least partially enclosing workspaces and the like. The use of upright wall panels, and the joinder of a plurality of such panels in aligned and/or transverse relationship to define workspaces and the like, is a well known and extensively utilized practice, whereby further description and discussion thereof is believed unnecessary.

The wall panel 10, as illustrated by FIG. 1, includes an interior upright frame 11 which, as is also known, is adapted to removably mount one or more cover pads or tiles 12 on opposite side faces of the frame. The wall panel 10 of this invention is provided with an improved structural top cap arrangement, the latter specifically including an elongate top cap 13, which rigidly couples to and extends lengthwise along the upper edge of the interior frame 11.

Figure 2:
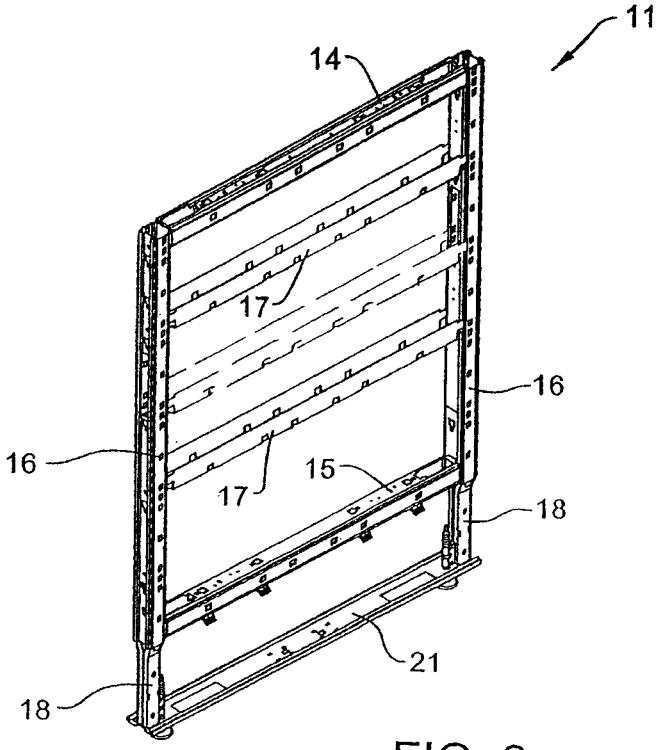
FIG. 2 is a perspective view of solely the rigid interior frame as associated with the upright wall panel of FIG. 1, the side cover pads being removed for clarity of illustration.

The interior frame 11 may assume other known constructions but, in the illustrated embodiment of FIG. 2, is of a generally open but rectangular rigid construction defined by horizontally elongated and vertically spaced top and bottom frame rails 14 and 15, respectively, which frame rails in turn are rigidly joined adjacent opposite ends thereof by upright edge or side rails 16 which extend vertically in generally perpendicular relationship to the horizontal rails 14-15. The frame rails 14, 15 and 16, in the illustrated and preferred construction, are rigidly joined, preferably by welding, and each is preferably formed from an elongate hollow metal tube having a cross-section which is generally rectangular and more specifically generally square. The frame rails, including specifically the uprights 16, are provided with openings through the side faces thereof which, in a conventional manner, accommodate clips or hooks provided on the cover pads 12 for permitting the cover pads to be attached to the frame substantially in engagement with the side faces thereof. The frame 11 as illustrated by FIG. 2 may also be provided with intermediate horizontally extending cross-rails or beams 17 which can be either permanently or removably engaged with the uprights 16, whereby the number and location of such crossbeams can be selected in accordance with the mode of usage of the upright wall panel, the size and number of cover pads provided on the side faces thereof, and the types and locations of cooperating accessory structures.

Figure 3:
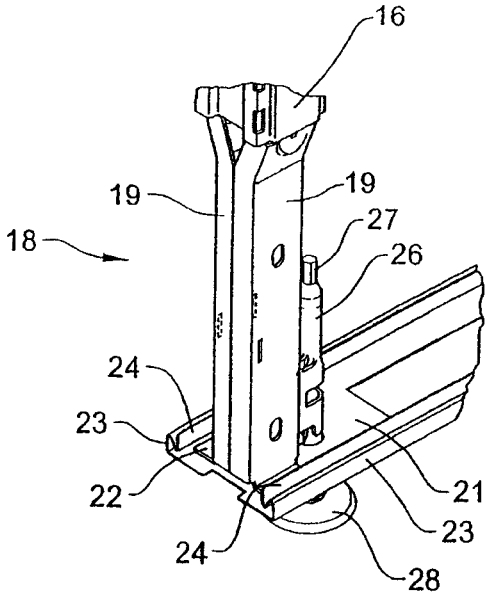
FIG. 3 is an enlarged fragmentary perspective view showing a lower corner portion of the frame illustrated in FIG. 2.

In the frame 11 as illustrated by FIGS. 2 and 3, each of the uprights 16 has a lower end part 18 which is configured to define an open interior raceway extending horizontally along the panel adjacent the lower edge thereof for accommodating telecommunication and/or electric cabling therein. This lower end part 18, to provide clearance for cabling which extends horizontally between adjacent panels, is defined generally by platelike side members 19 which protrude upwardly and are joined generally back-to-back, thereby providing clearance for cables adjacent opposite side faces thereof. This lower leg part 18 rigidly joins to a horizontally elongate member, specifically a bottom pan 21 which is vertically spaced downwardly from but extends generally parallel with the horizontal rail 15. This member 21 is fixedly secured to lower ends of the leg parts 18 and, for this purpose, the lower ends of the side members 19 define thereon a pair of generally horizontally oriented side flanges 22 (FIG. 3) which protrude sidewardly in opposite directions and which bear on the bottom pan 21.

The pan 21 has upwardly protruding side flanges 23 which extend upwardly adjacent opposite sides of the bottom wall and protrude lengthwise therealong, whereby the bottom pan 21 has a generally cup-shaped upwardly-opening configuration, and has a width which generally corresponds to the width of the frame uprights 16 and associated cover tiles 12. The bottom pan side flanges 23, at the upper lengthwise-extending extremities thereof, are provided with upper edge parts 24 which are initially bent inwardly and then upwardly so as to define a slotted shoulder or step on which a lower horizontally extending edge of a removable side cover or tile 12 can be positioned.

The lower end part 18 of each frame upright 16 also has, as illustrated in FIG. 3, a leg support bracket 26 fixed thereto, such as to an inner surface of the lower part 18. This leg support bracket accommodates therein a vertically elongated threaded shaft 27 which can be rotatably threadably moved relative to the bracket so as to adjust the elevation of the threaded shaft, which threaded shaft at its lower end mounts a support foot or glide 28 which provides a cooperative supportive engagement with a floor. When the selected wall panels have been joined serially in a desired orientation, such as in aligned or transverse orientation, then a side cover pad can be attached to the frames in a desired and generally conventional manner, such being diagrammatically depicted in FIG. 1 which illustrates one of the cover pads in a partially detached condition.

Figure 4:
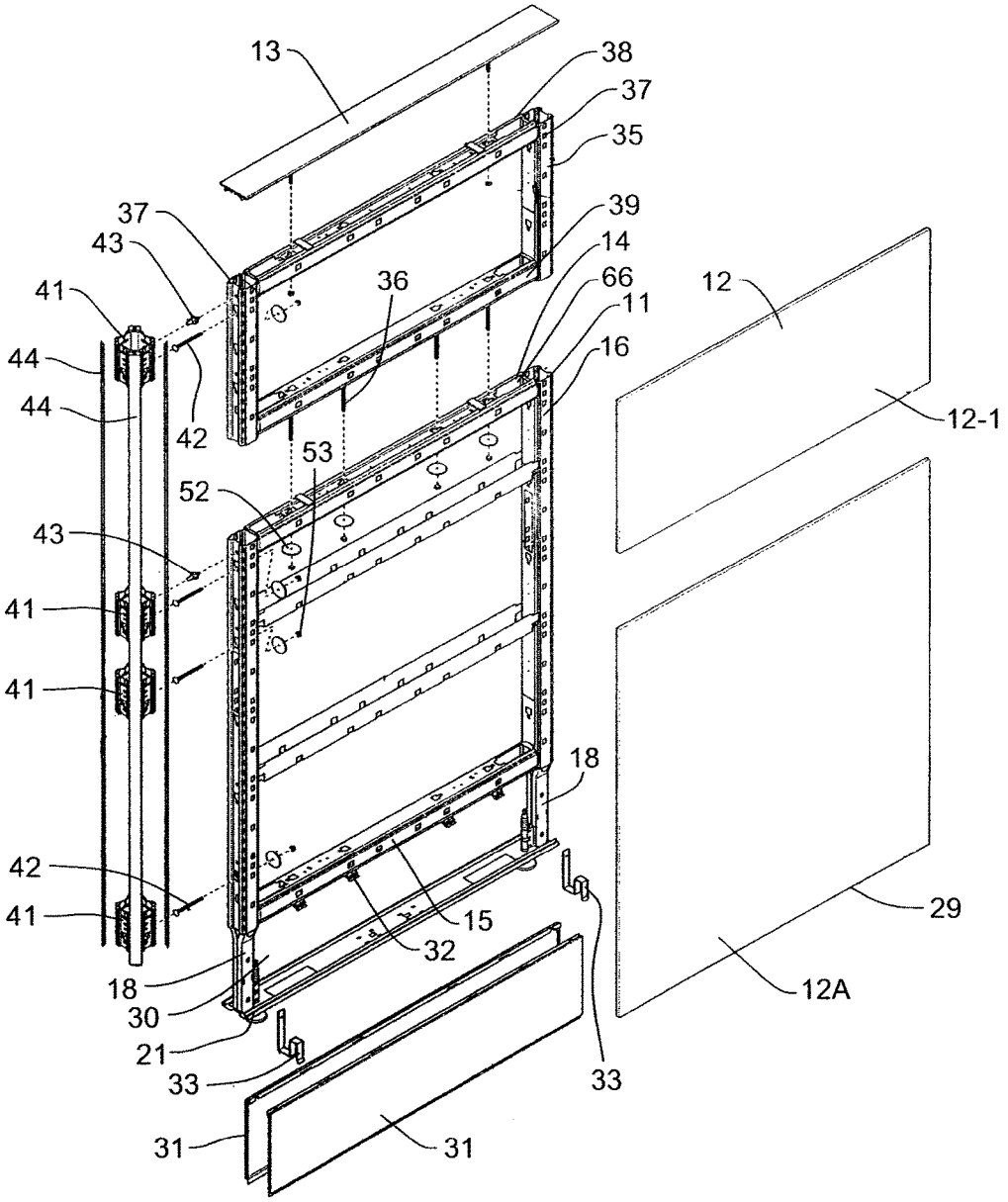
FIG. 4 is an exploded perspective view of a base panel frame, stack-on frame, and associated trim covers, as well as basic components of the corner connector arrangement.

Referring to FIG. 4, a further exploded view of the wall panel components is provided which further includes a base frame 11, a cover tile 12 and a larger-height cover tile 12A which is adapted to mount to the frame in a position wherein the bottom edge 29 thereof is disposed at floor height closely adjacent to the bottom pan 21 so as to enclose the raceway 30. Alternatively, the wall panel 12A may be replaced with a shorter height wall panel such as wall panel 12 which would leave open the raceway 30, which raceway 30 would then be enclosed on opposite sides by raceway covers 31 which would interconnect with the bottom pan 21 and appropriate connectors 32 located on the bottom of the bottom frame rail 15. The raceway 30 would then be accessible and adapted to support appropriate power or telecommunication data cables therein, which cabling may be supported on appropriate cable brackets 33 which mount to the face of the lower leg part 18. Additionally, an extension panel 35 may be provided that has a rectangular shape and is readily mountable to the top frame rail 14 through appropriate carriage bolts 36 as will be described in further detail hereinafter. Generally, the extension panel frame 35 comprises two short vertical upright rails 37 which are formed substantially the same as but shorter, than the vertical frame rails 16. Additionally, the extension panel 35 includes top and bottom horizontal frame rails 38 and 39 respectively which join to the vertical frame rails 37 in an identical manner to the joining of the frame rails 14, 15 and 16 of the base frame 11. When the extension panel frame 35 is mounted to the base panel frame 11, the top cap 13 then would mount to the top frame rail 38 rather than the frame rail 14.

Additionally, to define multi-way corner connections such as a two-way, three-way or four-way connections, the wall panel system further includes an arrangement of connector blocks 41 which are each formed identical to each other and are individually mountable to either of the vertical frame rails 16 or 37 described above, which connection is accomplished through carriage bolts 42. Preferably, alignment pins 43 are provided which mate between the corner blocks 41 and the associate frame rail 16 or 37 to maintain proper vertical alignment thereof. For such multi-way connections, vertically elongate corner light blocks 44 are provided as will be described in further detail hereinafter.

Figure 5:
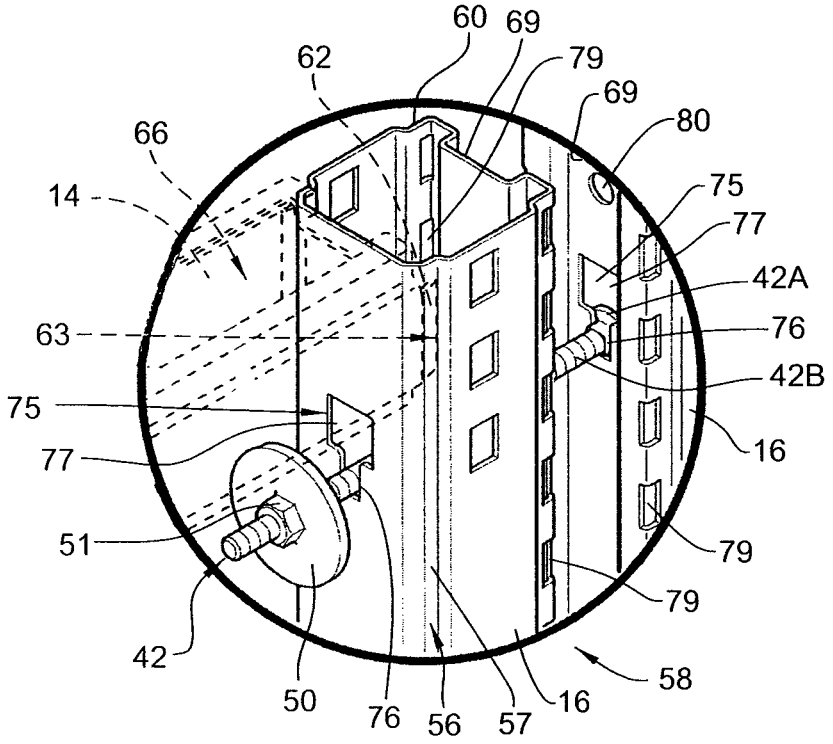
FIG. 5 is an enlarged fragmentary view of a bolt connection between adjacent panel frames.
Figure 6:
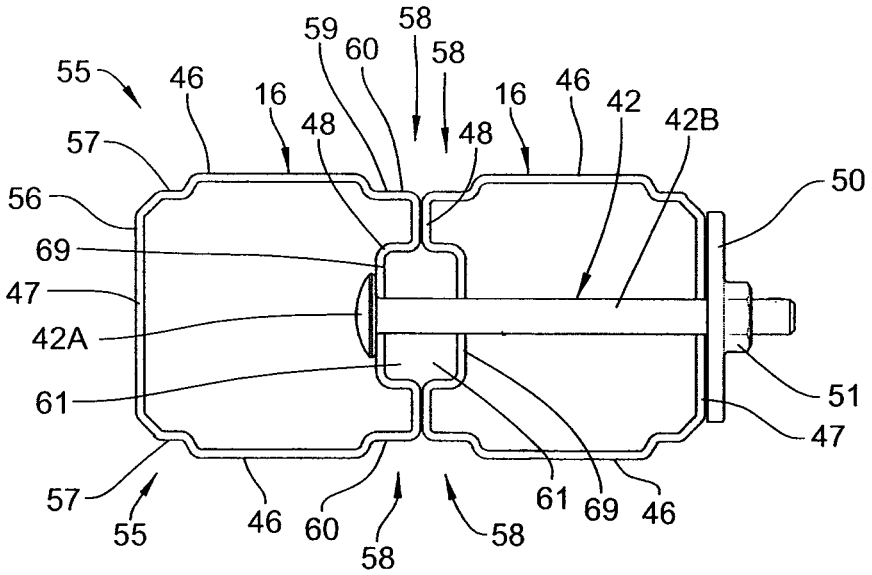
FIG. 6 is a top plan view of the bolt connection and interconnected vertical frame rails.

The wall panel 10 of the invention and specifically the frame 11 thereof has an improved frame construction as defined by the frame rails 14, 15 and 16 which are each formed with the same or common cross-sectional profile. Referring to this profile as illustrated in FIG. 6, this profile is defined by side walls 46, interior wall 47 and outer wall 48. The side walls 46 are generally-planar and extend substantially across the width of the frame rail 14, 15 or 16. FIGS. 5 and 6 illustrates the interconnection of two serially adjacent vertical frame rails 16 by the carriage bolt 42 which further comprises a washer 50 and nut 51. FIG. 4 similarly illustrates the top cross rail 14 of the bottom frame 11 being interconnected and joined together with the bottom cross rail 39 of the extension frame 35. These frame rails 14 and 39 are joined together by the aforementioned carriage bolt 36 which further includes a respective washer 52 and nut 53 and is the same as bolt 42. While these frame rails are designated by reference numerals 14, 16 and 39, it is noted that all of these frame rails have the same cross-sectional profile and as such, common reference numerals 46, 47 and 48 are used to designate the respective side walls, inner wall and outer wall thereof. While the frame rails 14, 16 and 39 as well as additional rails 38 and 15 have different specific constructions between the vertical rails versus the horizontal rails, these common cross-sectional profiles allow for a simplified manufacturing process with the primary difference being in the formation of rail-specific apertures which would initially be stamped into the material before roll forming is performed to form the tubular shape illustrated in FIG. 6.

The following discussion primarily focuses on one of these frame rails with the common reference numerals being applied to the remaining frame rails. More particularly, FIG. 6 illustrates the leftward frame rail 16 as being stepped in the region of the inner corners 55 to define a narrowed interior section 56 which terminates at corner flats 57. Additionally, the outer corners 58 also define a narrow outer portion 59 defined by outer corner flats 60. A central recess or channel 61 which extends longitudinally along the length of the frame rail and opens up outwardly therefrom is seen in FIG. 6. The cooperation of these various formations with each other in the construction of the frame will be discussed in further detail hereinafter.

More particularly as to FIG. 5, FIG. 5 illustrates the horizontal frame rail 14 being interconnected to the upper end of the vertical frame rail 16 to define an upper corner of the panel frame 11.

To join the horizontal frame rail 14 or even rail 15 to the vertical rail 16, each of the side walls 46 of the frame rail 14 as well as the frame rail of 15 is formed with a welding flange 62 projecting sidewardly therefrom such that each opposite end of a horizontal frame rail 14, 15, 38 or 39 is provided with a pair of spaced apart, parallel weld flanges 62 which fit over and straddle the narrowed interior portion 56 of the respective vertical frame rail 16 or 37. Specifically as to FIG. 6, these weld flanges 62 abut against the corner flats 57 of the narrowed interior portion 56 and then are welded thereto along the terminal edge 63 of the weld flange 62. As such, these weld flanges 62 properly align the horizontal rail with the vertical rail 16 prior to welding and automatically position the weld flange 62 in an appropriate position against the opposing corner flat 57 to which the weld flanges 62 are secured. The structural configuration illustrated in FIG. 5 as well as various additional drawings herein which correspond to this construction provides an improved arrangement to facilitate welding of the vertical and horizontal frame rails.

Figure 11:
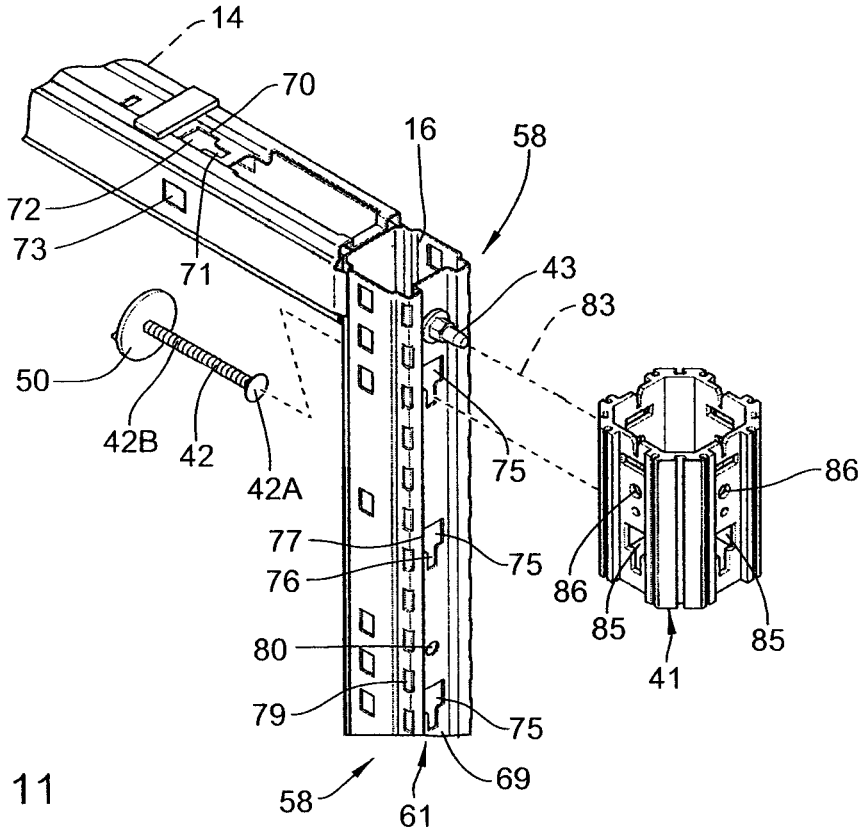
FIG. 11 is an exploded view illustrating the bolt connection between a panel frame and corner block.

It is noted that the various frame rails, whether horizontal or vertical, have the same cross-sectional profile as each other. However, the horizontal frame rails are formed with different patterns of openings therein. In this regard and referring to FIGS. 4 and 5, the horizontal frame rails include passages 66 extending vertically therethrough. Due to the common patterns of openings in these frame rails, common reference numerals are used for these openings. More particularly as seen in FIG. 11, the horizontal frame rails further include horizontally spaced apart T-shaped openings 70 which are defined by a narrow portion 71 and a wide portion 72. As will be better understood from the following discussion of bolt 42, the wide portion 72 is adapted to receive the head of the carriage bolt 36 therethrough, while the narrow portion 71 accommodates the shank of the bolt 36 wherein assembly is performed by first inserting the head through the wide portion 72 and then shifting the carriage bolt sidewardly into the narrow portion 71, after which the associated nut 53 is tightened in place.

The side rail walls 46 also include rectangular openings 73 which are provided to support the cover tile 12 thereon. Further discussion of this feature is not required.

Next as to the vertical frame rails 16, these frame rails 16 also are formed similar to each other in that they include their own respective patterns of openings therein.

Figure 12:
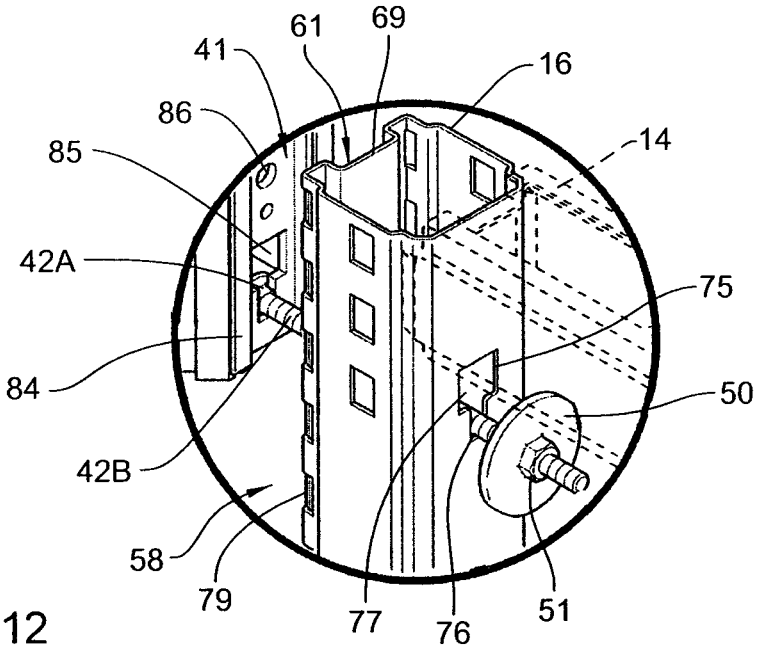
FIG. 12 is an enlarged fragmentary perspective view of the bolt connection of FIG. 11.

In particular, as seen in FIGS. 5 and 11-12, the vertical frame rails 16 include vertically spaced-apart T-openings 75 in each of the inner wall 47 and the bottom wall 69 of the channel 61, which T-openings 75 in the inner wall 47 and bottom wall channel 69 are horizontally aligned with each other in associated pairs of such T-openings 75. Each T-opening 75 is similarly formed with a narrow portion 76 and wide portion 77 do thereby accommodate the head of a carriage bolt in the wide portion 77 and allow for sliding of the bolt shank into the narrow portion 76 for securement of two adjacent wall panel frames together as seen in FIG. 5. As best seen in this figure, the carriage bolt 42 has a length which extends through the entire thickness of one frame rail 16 and only partially into and through a single one of the rail walls, namely outer rail wall 48 of the serially adjacent frame rail 16. As such, the head 42A seats in the narrow portion 76 of one frame rail 16 and abuts against the slot wall 69 wherein the rectangular portion of the carriage bolt head 42A is prevented from rotating in the narrow slot portion 76 (FIG. 12). The shank 42B of the lag bolt then passes through the aligned T-shaped opening 75 of the other frame rail 16 and the innermost T-opening 75 formed in the inner wall 47 thereof. Assembly is accomplished by sliding the bolt head 42A horizontally through the aligned wide portion 77 of the aligned T-opening 75 and then slipping the bolt shank 42B downwardly into the narrow portion 76, after which the washer 50 is placed in position and the nut 51 tightened to rigidly join the serially adjacent frame rails 16 together. In a similar manner, the horizontal frame rails 14 and 39 (FIG. 4) also are secured together with the carriage bolt 36.

In addition to the T-openings 75 discussed above, additional aperture formations are provided in the vertical rails. In particular as seen in FIGS. 5 and 11-13, outer corners 58 also are provided with vertical rows of slots 79 which are used in a conventional manner for the mounting of accessory brackets such as overhead storage units and the like. Still further, additional holes 80 are provided in vertically spaced relation which holes 80 are adapted to receive the aforementioned alignment pins 43 as generally illustrated in FIG. 11. Each alignment pin 43 (FIG. 10) includes a threaded engagement section 81 which is fixedly secured in associated hole 80, as well as a projecting pin portion 82 which projects outwardly therefrom and is adapted to align with the corresponding hole 80 in an adjacent frame rail 16 as indicated by dotted line 83 in FIGS. 10 and 11. By inserting the various pin portions 82 of the alignment pins 43 in an adjacent frame rail, these serially adjacent frame rails 16 may initially be aligned with each other before engagement of the carriage bolts 42 described above.

Figure 7:
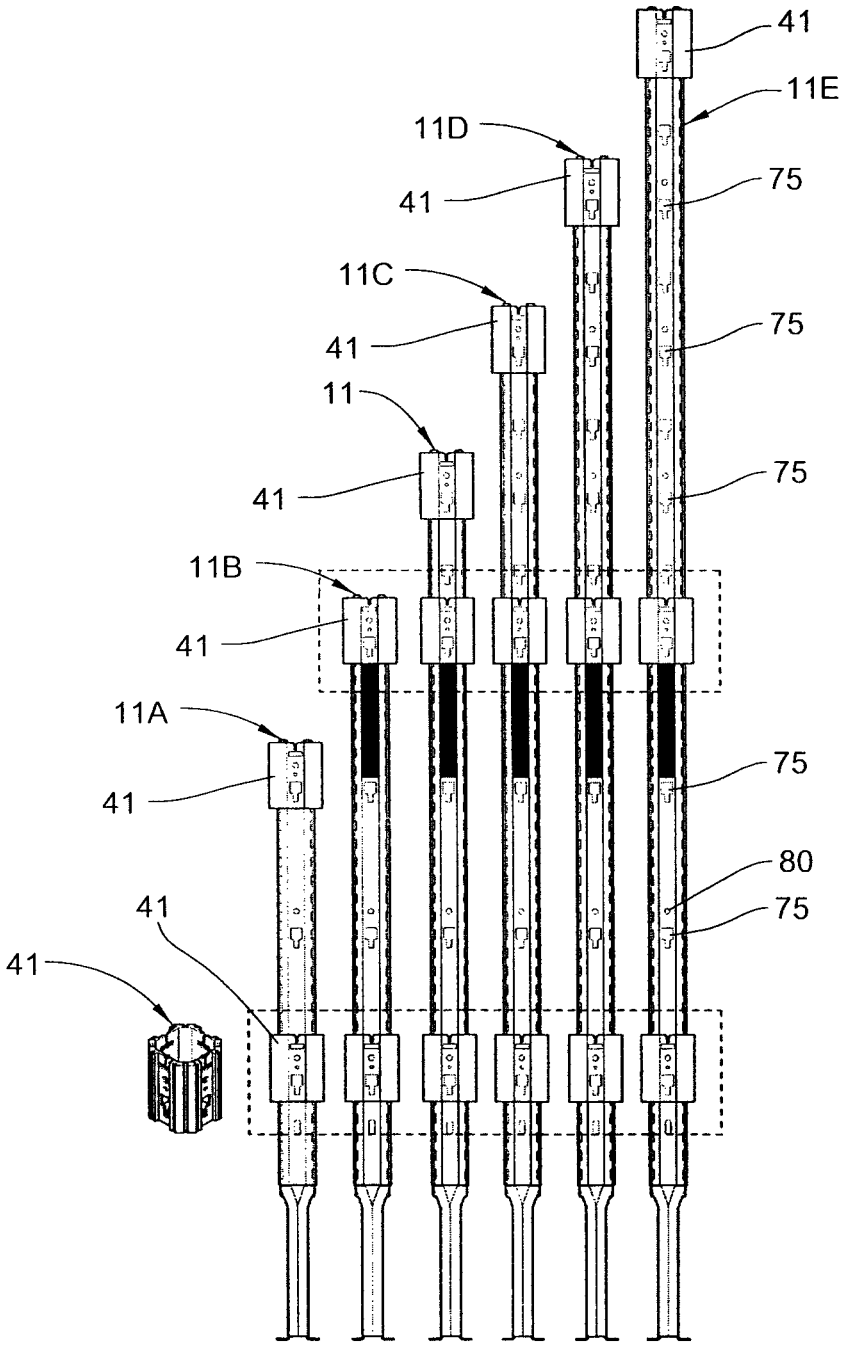
FIG. 7 is an end elevational view illustrating various panel heights for the panel frames preferred and locations of corner blocks for connection of such panel frames together.

FIG. 7 illustrates a variety of variable height panel frames including panel frame 11 as well as other different height frames 11A-11E. These panel frames include appropriate vertical frame rails and due to the variable heights have different arrangements for mounting the corner blocks 41 as depicted in FIG. 7.

Figure 9:
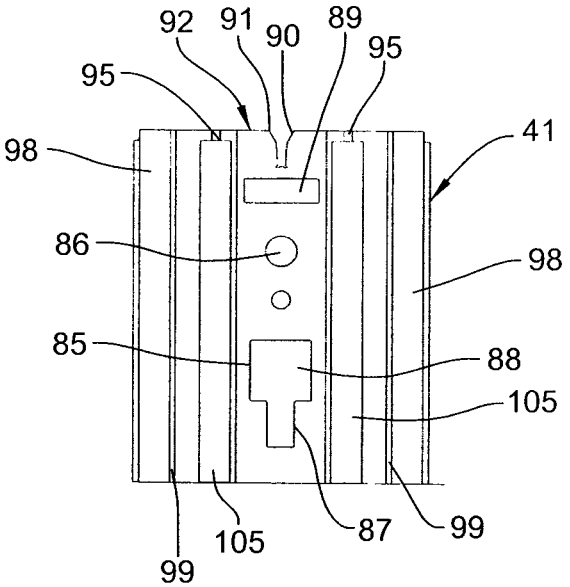
FIG. 9 is a side elevational view of the corner block.
Figure 10:
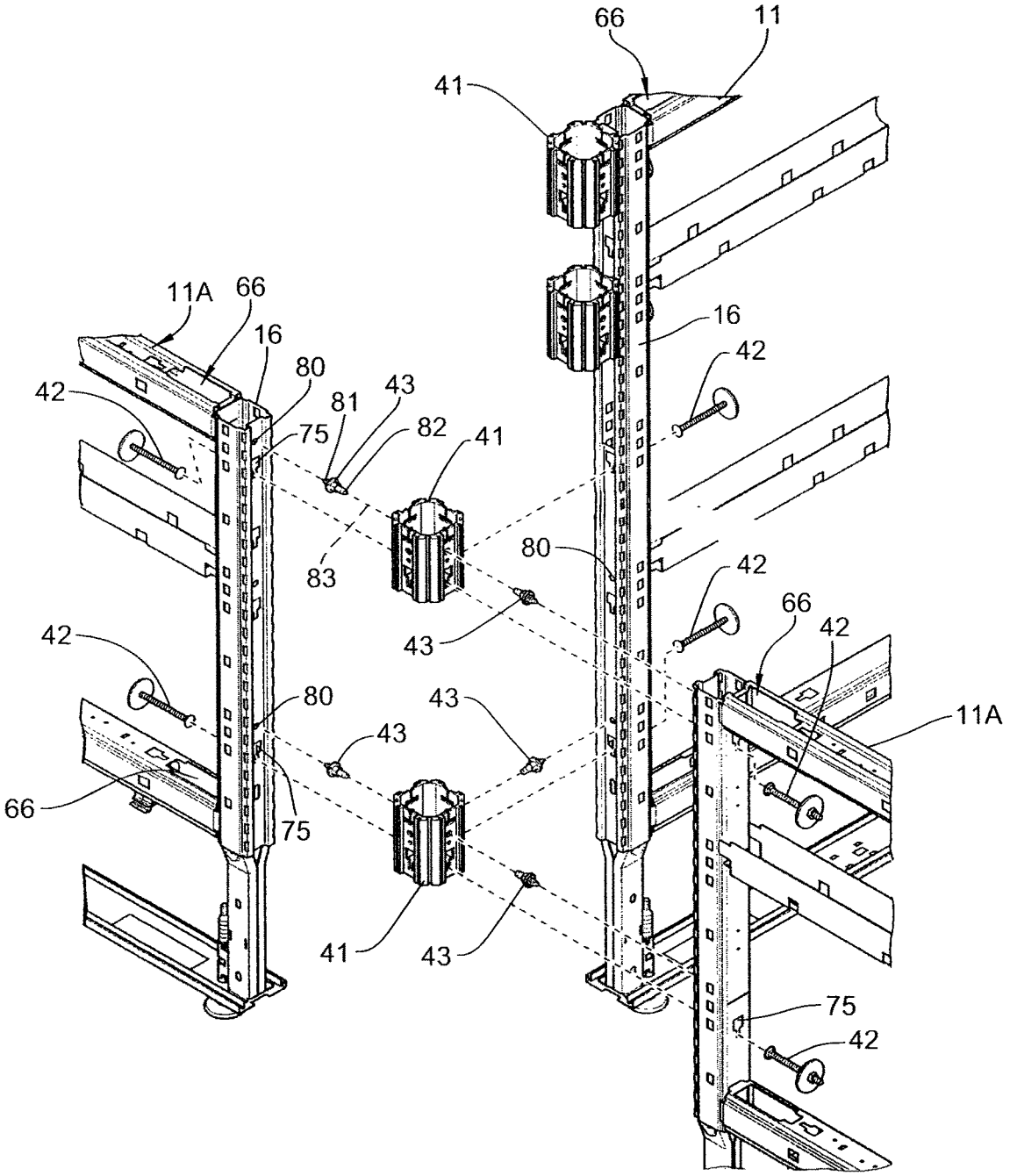
FIG. 10 is an exploded view of a three-way connection of panel frames.

Turning next to FIGS. 9-10, multi-way corner connections are defined through the use of the corner blocks 41 previously illustrated in FIG. 4. These corner blocks 41 are tubular metal extrusions, preferably formed from extruded aluminum and are configured to join selectively to multiple panel frames 11 and specifically to the vertical frame rails 16 or 37 thereof.

As to FIG. 10, a full-height panel frame 11 is illustrated being joined to shorter-height panel frames 11A through the use of two corner blocks 41 disposed between these three panel frames. It is noted that additional upper corner blocks 41 are mounted to the upper end of the panel frame 11 above the upper edge of the shorter frames 11A which upper corner blocks 41 provide for the mounting of additional wall panels thereto, wherein the lower corner blocks 41 join serially between two adjacent panel frames 11A and the full-height frame 11 to define a three-way corner connection.

Figure 8:
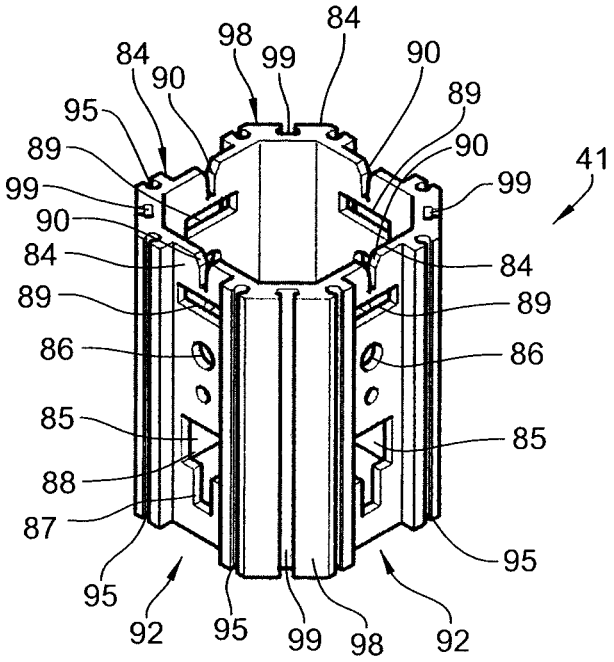
FIG. 8 is an enlarged perspective view of a corner block.
Figure 13:
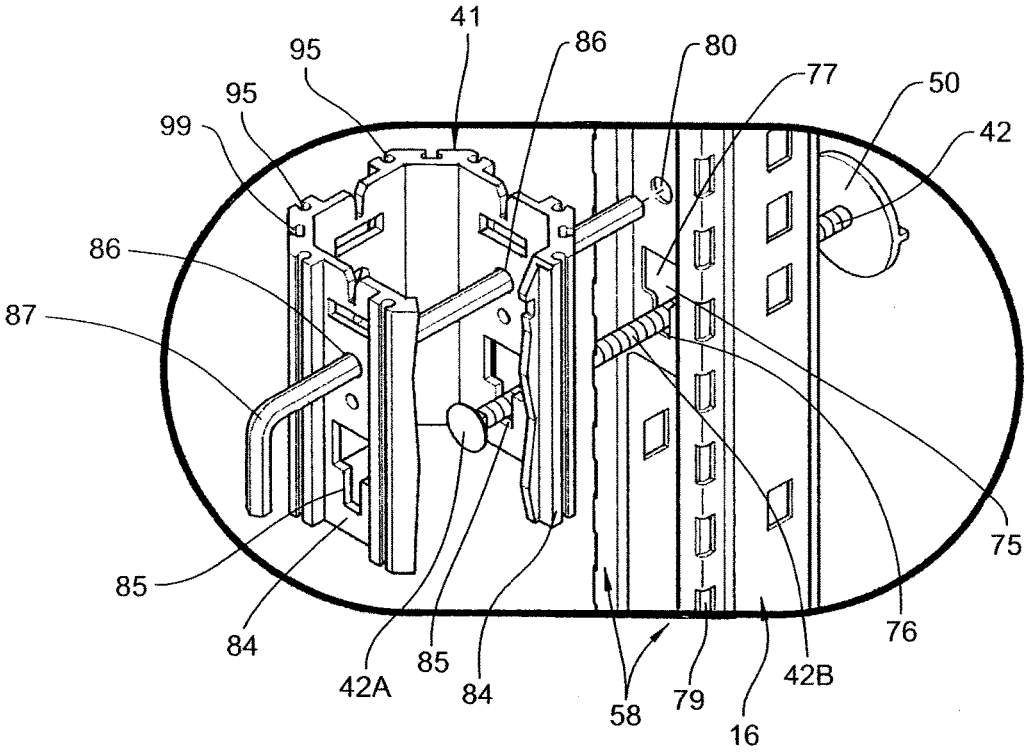
FIG. 13 is an enlarged fragmentary perspective view illustrating the alignment process for mounting an intermediate corner block to a panel frame.

As generally seen in FIGS. 8 and 9, the corner blocks 41 each include four block walls 84 which extend vertically in a rectangular cross-sectional profile as viewed from above. Each of the block walls 84 includes a pattern of openings formed therein which each comprise a T-opening 85 which is structurally and functionally the same as the T-openings 70 and 75 described above. More particularly, the T-openings 85 are configured for horizontal alignment with the T-openings 75 formed in the vertical frame rails 16. As seen in FIGS. 12 and 13, the head 42A of the bolt 42 engages one block sidewall 84 with the shank 42B being extended through the frame rail 16 and the washer 50 and nut 51 being fitted onto the end of the shank 42B and tightened so as to secure the corner block 41 to the vertical frame rail 16.

Typically the corner block 41 is positioned on one of the frame rails 16 and then the other wall panel frames 11 or 11A are positioned adjacent thereto and then attached by suitable bolts 42.

Figure 18:
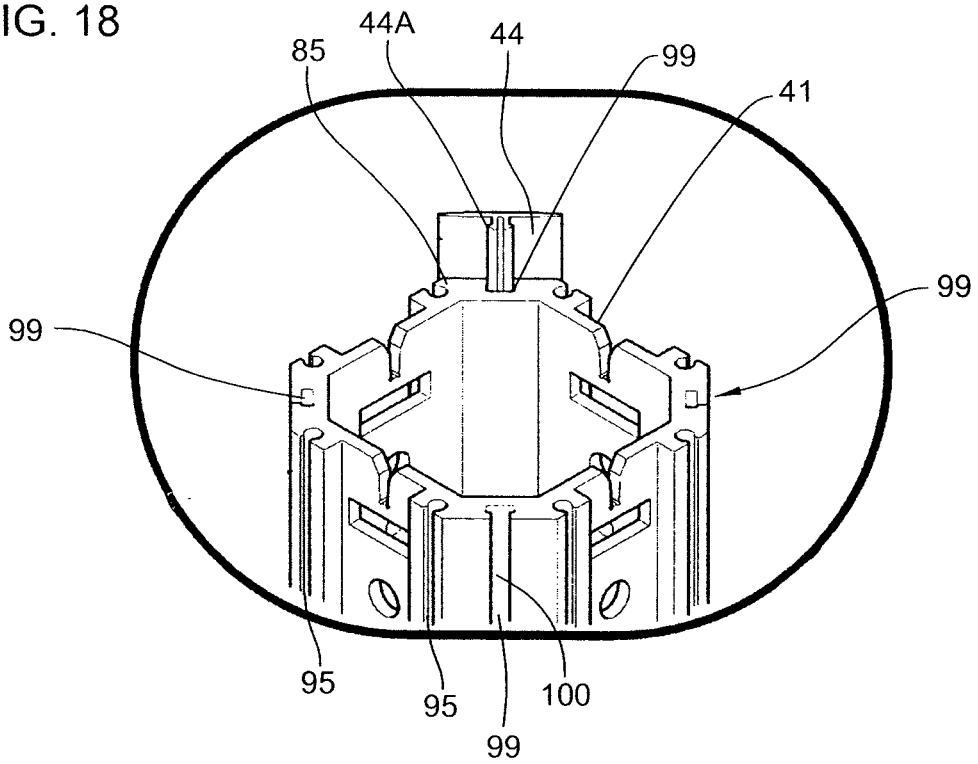
FIG. 18 is an enlarged fragmentary perspective view of the corner block and a corner light block being slidably inserted into engagement therewith.

To ensure alignment of the corner block 41 on the frame rail 16, each block sidewall 84 includes an alignment hole 86 which is adapted to receive the pin portion 82 of the alignment pin 43 as generally illustrated by phantom lines in FIG. 11. For those instances when mounting the first corner block 41 to a panel frame 16 where a pin 43 is not present, FIG. 18 illustrates an Allen wrench 87 being fitted horizontally through an aligned pair of the alignment holes 86 and then slid into with a corresponding hole 80 formed in the frame rail 16 to preliminarily align the components. This Allen wrench 87 could then be removed therefrom once the wall panel 11 or 11A is secured to the corner block 41.

Furthermore as to the T-openings 85 (FIGS. 8 and 9), these T-openings 85 are defined by a lower narrow portion 87 and a wider portion 88 which are substantially the same as the above-described T-openings 75 and the narrow and wide portions 76 and 77 thereof. As such, these T-openings 85 are adapted to be aligned with the corresponding T-openings 75 in a frame rail 16 while the corner block alignment hole 86 aligns with the corresponding hole 80 on the frame rail 16.

Vertically above the alignment hole 86, a horizontally elongate connector window 89 is provided, and thereabove, a mounting slot 90 is formed which opens vertically upwardly and has a slightly wider mouth 91.

It is noted that these various openings 85, 86, 89 and 90 are formed in a vertically elongate recess 92 which is formed in the central portion of the side block wall 84.

Figure 14:
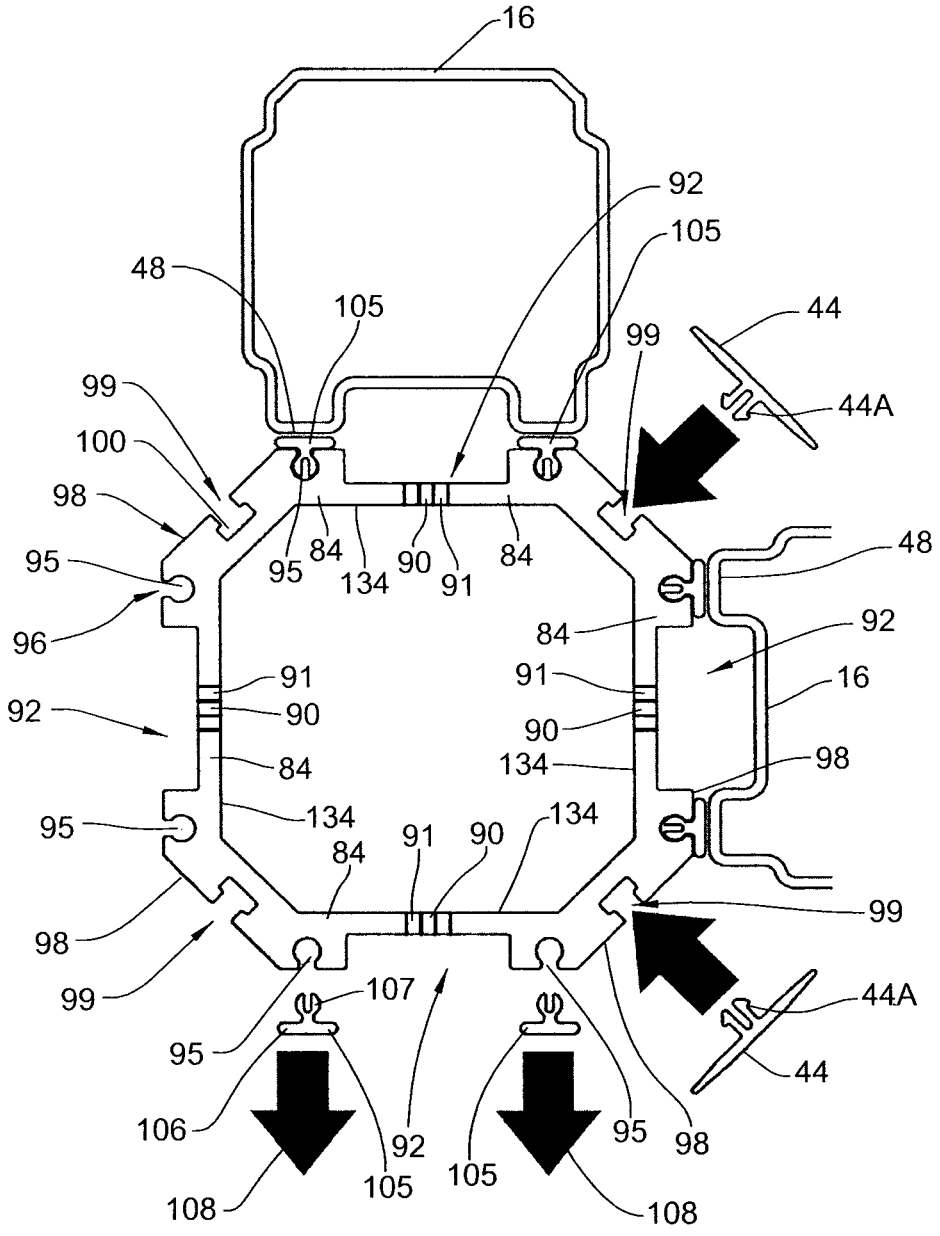
FIG. 14 is a diagrammatic plan view illustrating a two-way, right-angle corner connection.

Referring to FIGS. 8, 9 and also FIG. 14, these recessed portions 92 are disposed between thicker portions of the respective sidewalls 84 which thick portions define vertically elongate mounting slots 95 which open sidewardly through an open side 96 thereof and open vertically from opposite upper and lower ends thereof. Thus, each sidewall 84 includes a pair of such slots 95 in parallel, spaced relation.

Additionally, the sidewalls 84 are joined together at the four corners of the corner block 41 by angled corner portions 98 which are oriented at a 45° angle relative to each adjacent sidewall 84. These corner portions 98 further include mounting slots 99 which have a generally T-shaped profile that is open on a vertically elongate open side 100 and also opens vertically from opposite upper and lower ends thereof.

More particularly as to FIG. 14, the system of corner blocks of the invention further includes separate vertically elongate strip-like spacers 105 have a flat spacer body 106 and a connector rib 107 extending vertically along the length thereof which rib 107 is adapted to be snap fit into a respective mounting slot 95. Generally, the spacers 105 are provided so as to be sandwiched between the corner block wall 84 and in particular, the thick portion thereof and the opposing outer rail wall 48 of the vertical frame rail 16. As seen in FIG. 9, the spacers 105 have a vertical length which generally corresponds to the height of the corner block 41, and these spacers 105 as seen in FIG. 14 are positioned in place within the corresponding mounting slot 95 so as to abut against the opposing face of the frame rail 16 when the corner block is connected to such frame rail. Therefore, for each block wall 84 being abutted against a corresponding frame rail 16, a pair of such spacers 105 is provided, the purpose of which will be discussed in further detail hereinafter. On those block sidewalls 84 which would not be disposed adjacent a frame rail 16, the spacers 105 would be removed as generally indicated by reference arrows 108 (FIG. 14) typically by sliding the spacers vertically from the ends of the slots 95.

Additionally, at each multi-way corner connection, the corner blocks 41 also have mounted thereto the aforementioned corner light block strip 44 which is adapted to mount to the corresponding mounting slots 99 in the corner portions 98. As originally illustrated in FIG. 4, the light block strips 44 have a selected vertical length which corresponds to the height of the panel frame adjacent thereto. These light blocks 44 thereby provide a visual block in the corner portions of the multi-way connections to prevent the workstation occupant from being able to see through the corner connection. Since the corner blocks 41 only have a short vertical length relative to the total height of the panel frame 11, these corner blocks 41 do not serve a light blocking function and hence, the light block strips 44 are provided to block the vertical spaces disposed between vertically spaced apart corner blocks In addition to these components, namely, the corner blocks 41, the spacers 105 and the light blocks 44, FIG. 15 illustrates the additional components of the corner connector system, which additional components include the aforementioned top caps 13, a corner cap 110 and a single-side trim cover 111 which mounts to the corner blocks 41.

Figure 15:
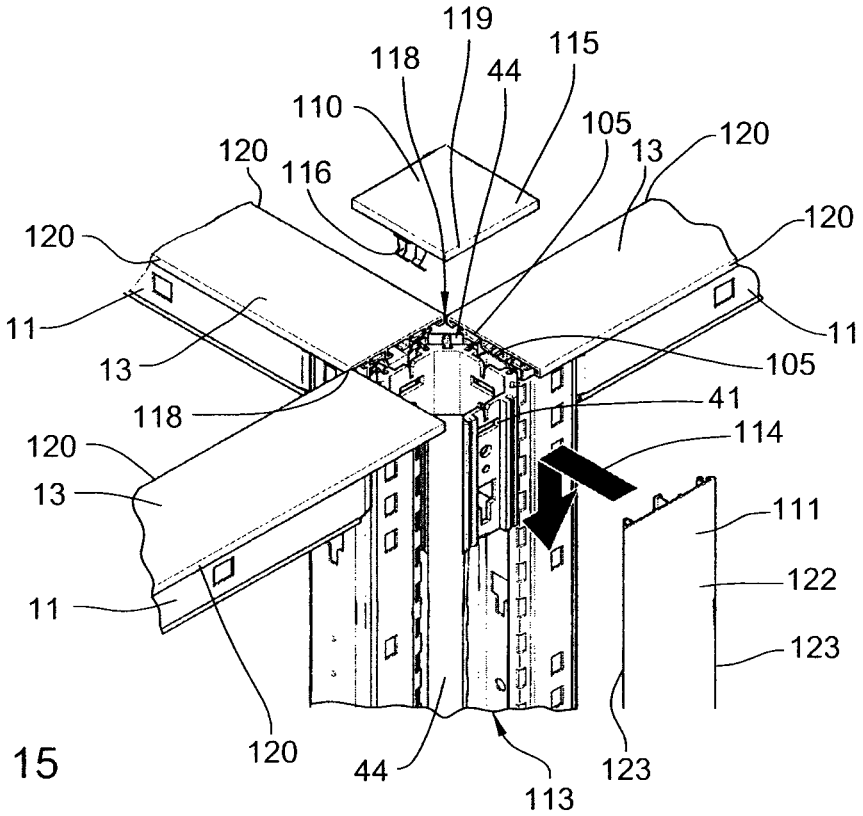
FIG. 15 is an exploded perspective view illustrating a three-way corner connection.
Figure 16:
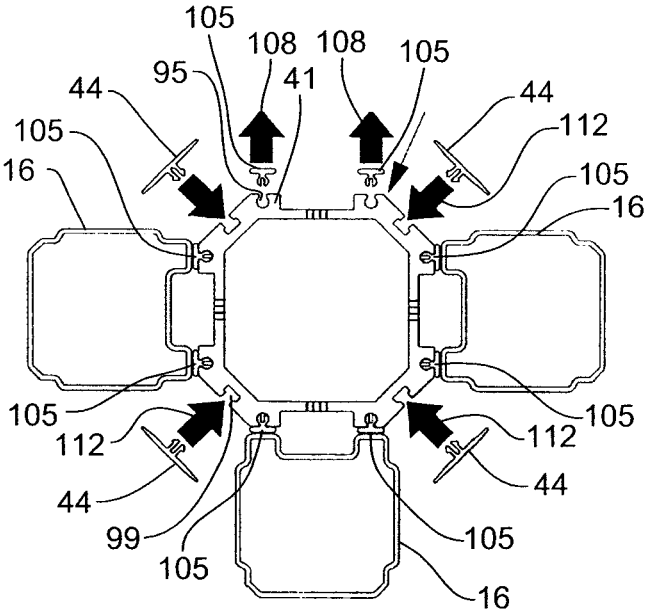
FIG. 16 is a plan view illustrating the three-way connection.

More particularly as to how these components are interconnected together, FIGS. 15 and 16 illustrate a three-way corner connection. In this corner connection, the appropriate number of corner blocks 41 are mounted along the vertical edges of the three panel frames 11 illustrated therein. The top caps 13 also are mounted to the appropriate panel frames 11. When joining the vertical frame rails 16 to the corner block 41, a pair of spacers 105 are disposed between each of the opposing faces of the block wall 84 and the associated frame rail 16. On the fourth side of the corner block which remains open, any premounted spacers 105 would be removed therefrom, it being understood that the spacers 108 might be pulled sidewardly out of the corresponding mounting slot 95 but preferably would be slid vertically out of the open end of the slot 95.

Figure 17:
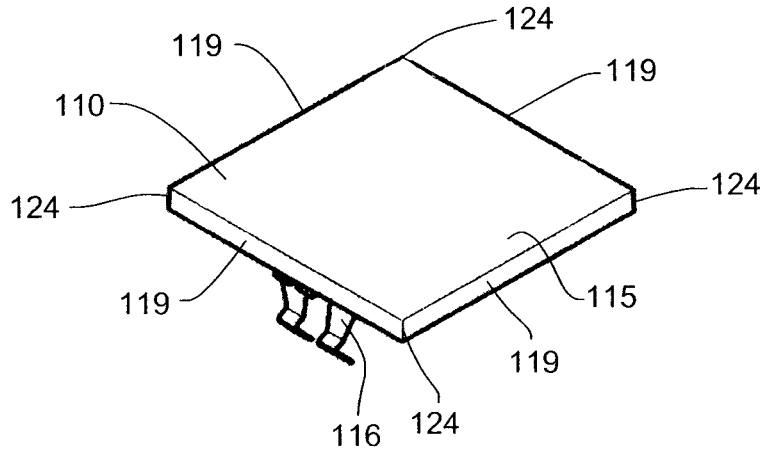
FIG. 17 is a perspective view illustrating a corner cap.

In each of the corner portions 98, an appropriate light block 44 is mounted into each corresponding mounting slot 99 as indicated by reference arrows 112. One of these light blocks 44 is illustrated in FIG. 15 in position adjacent to the leftward panel frame 11. To enclose off the open side of,this three-way corner connection, the trim cover 111 is positioned over this open side 113 by shifting same horizontally and then downwardly into engagement with the corner block 41 as indicated by reference arrow 114. As to the corner cap 110 (FIGS. 15 and 17), this corner cap 110 is generally formed of a rectangular trim body 115 formed of a suitable material such as aluminum, which trim body 115 includes downwardly depending resilience spring legs 116 on opposite sides thereof. FIG. 17 illustrates one spring clip 116 with it being understood that the opposite side of the corner cap 110 is a mirror image thereof. These spring clips 116 are resiliently deflectable and adapted to snap into the corresponding connector slots or windows 89 formed near the upper edge of the corner block 41.

These corner strips 44 are slid sidewardly into the open side of the corresponding mounting slot 99 as generally illustrated in FIG. 18 with the corner strip 44 projecting upwardly a short distance.

Due to the addition of the spacers 105 between the corner block 41 and each panel frame 11 mounted thereto, the intersecting corners 118 (FIG. 15) of the top caps 13 are precisely aligned with each other. As such, each side 119 of the cap body 115 is the same width as the corresponding top cap 13. This provides uniform trim lines along the longitudinal edges 120 of the various top caps 13 and the corner cap 110 and the cap side edges 119 thereof.

As to FIG. 15, it is understood that the panel frames 11 further includes the cover tiles 12 mounted thereto which cover tiles 12 have a tile face 12-1 that is aligned in a vertical plane with the trim cap edges 120 as well as the edges 119 of the corner cap 110.

Figure 19:
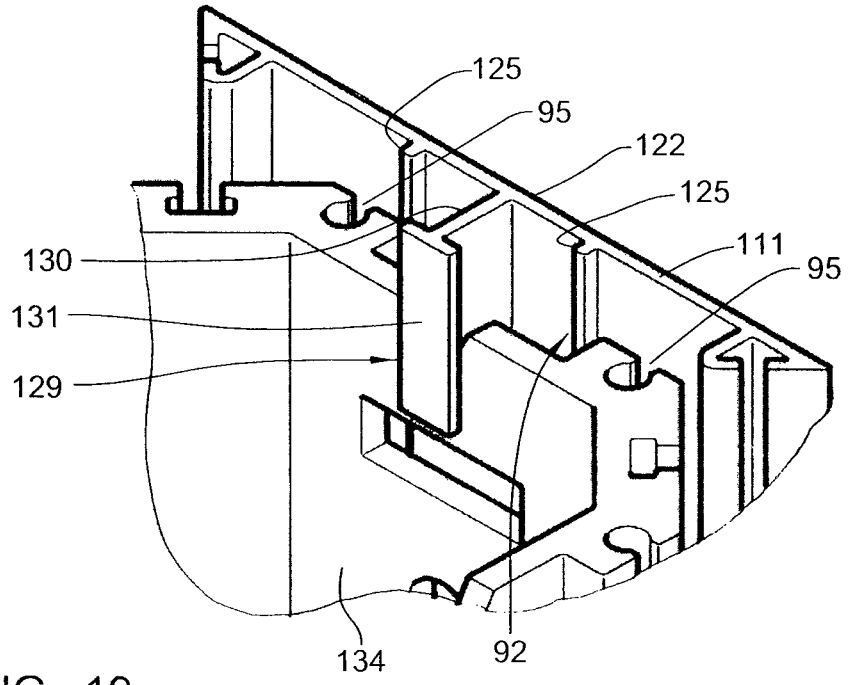
FIG. 19 is an enlarged fragmentary perspective view illustrating a single-side trim cover being mounted to the corner block.
Figure 20:
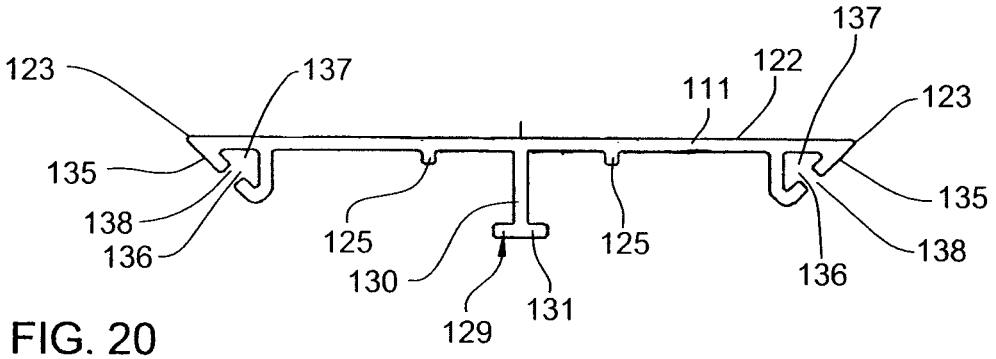
FIG. 20 is an end view illustrating the profile of the trim cover.

On the open side of the three-way corner connection, the trim cover 111 as illustrated in FIGS. 15, 19 and 20 also has a trim face 122 which is oriented vertically and lies in the same vertical plane as the adjacent cover tile faces 12-1 and the top cap edges 120. This trim cover face 122 also is aligned vertically below the adjacent cover cap edge 119 in the same vertical plane, while the width of the trim cover 111 extends between vertical edges 123 and corresponds to the width of the corner cap 110 as defined between the corners 124 thereof. Thus, the trim cover 111 also provides aesthetic trim lines defined by these corners 123 which are vertically aligned, with the corner cap 110 and corners thereof.

More particularly as to the trim cover 111 illustrated in FIGS. 19 and 20, the trim cover 111 includes two rearwardly projecting locator ribs 125 which align within the corner body channel 92 (FIG. 14) as seen in FIG. 19. However, when the trim cover 122 is mounted in position, the spacers 105 are removed from the corner block 41 on this side so that the mounting slots 95 therefor are empty.

Figure 21:
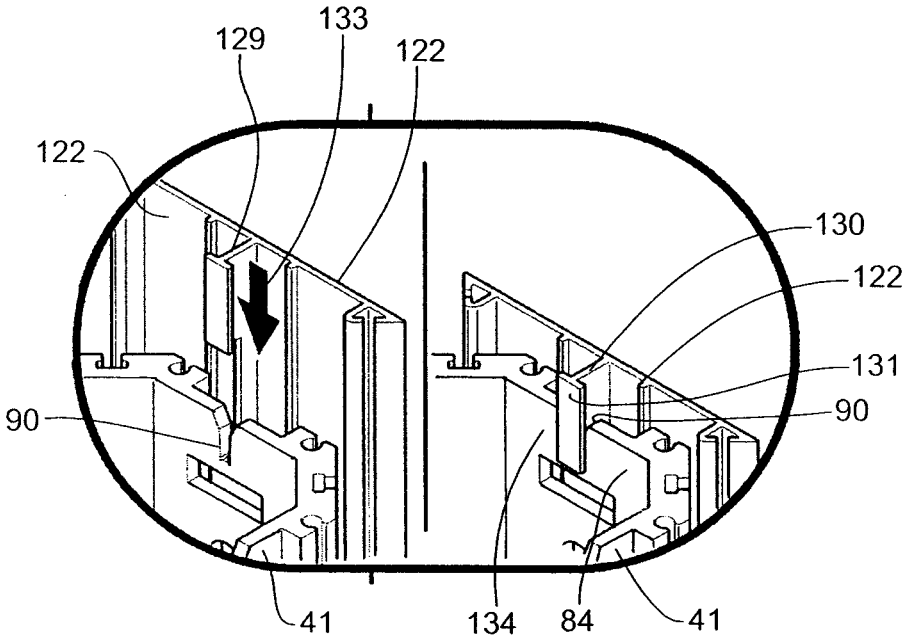
FIG. 21 is an enlarged fragmentary perspective view illustrating the trim cover being suspended from a corner block.

To mount and support the trim cover 122, the upper end of the trim cover includes an upper T-shaped support flange 126 that projects inwardly and is defined by a thin center web 130 and an enlarged end plate 131. This support web 130 is adapted to slide downwardly into the corresponding support slot or notch 90 formed in the corner block sidewall 84 as generally illustrated in FIG. 19. FIG. 21 illustrates this mounting flange 129 being vertically aligned with the corresponding support slot 90 and then the trim cover 122 is shifted downwardly as indicated by reference arrow 133 to seat the web 130 within the support slot 90 with the end plate 131 abutting against the inside face 134 of the corner block sidewall 84. It is noted that the generally V-shaped mouth 91 of the support slot 90 facilitates centering and alignment of the support flange 129 within the slot 90. In this manner, the trim cover 122 is suspended from the uppermost corner block 41 and retained in the mounted position by the top cap 110 which impedes upward displacement of the trim cover 122.

The trim cover 122 also includes additional support flanges 129 projecting rearwardly therefrom which additional flanges are spaced vertically along the length thereof for engagement with additional corner blocks 41 to maintain the trim cover 122 in position along its vertical length.

Figure 22:
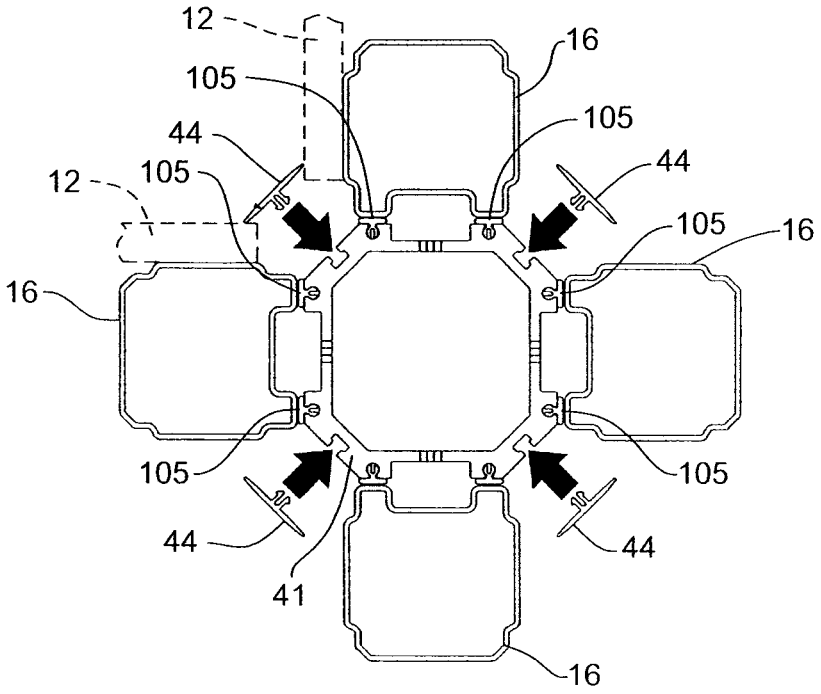
FIG. 22 is a plan view of a four-way corner connection.

When forming additional multi-way corner connections, FIG. 22 illustrates a four-way corner connection with the corner block 41 being connected between four different panel frames and specifically four different vertical frame rails 16 of such panel frames. For each of these panel frame rails 16, a pair of the spacers 105 is positioned therebetween wherein the various frame rails 16 are bolted to the corner block 41 as described above relative to FIGS. 11 and 12. For this four-way corner connection, four separate corner light blocks 44 are provided and the interconnected frames 11 include cover tiles 12 without the necessity of trim covers 111.

Figure 23:
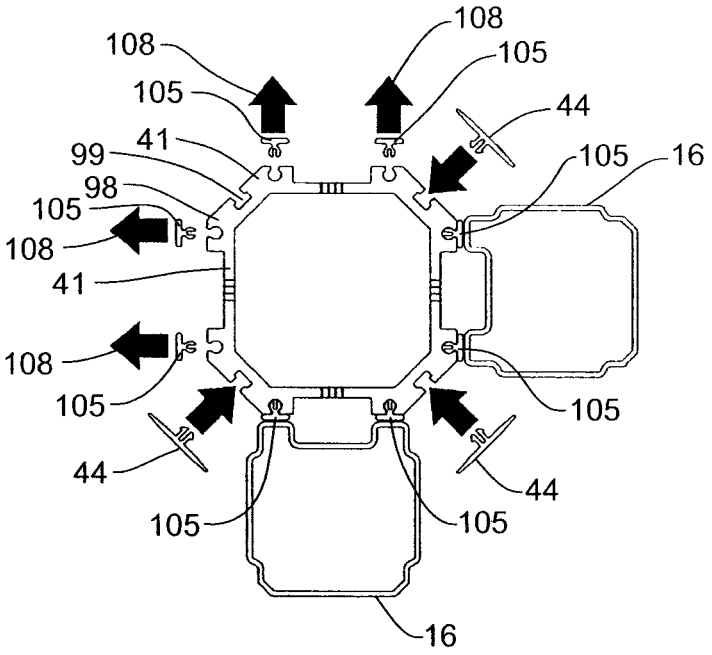
FIG. 23 is a plan view of a two-way right-angle corner connection.
Figure 24:
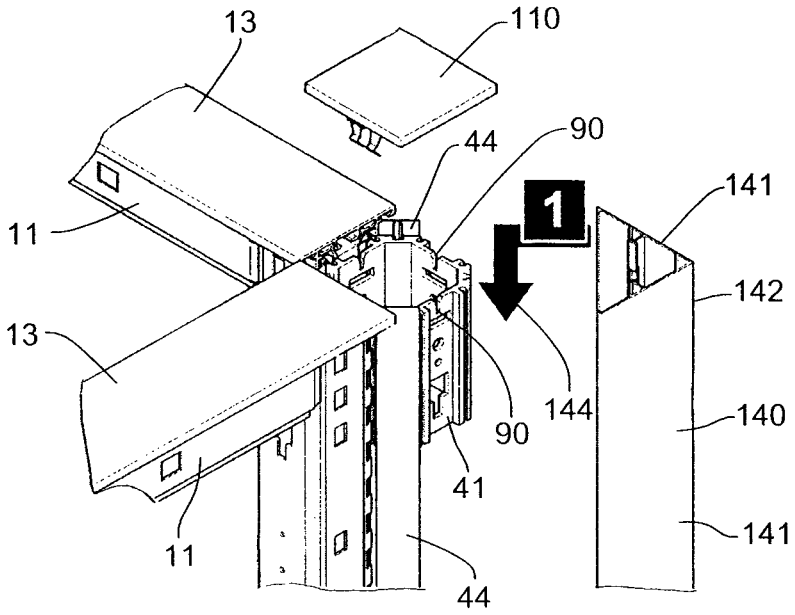
FIG. 24 is an exploded perspective view of a right-angle corner connection with a two-way trim cover.
Figure 25:
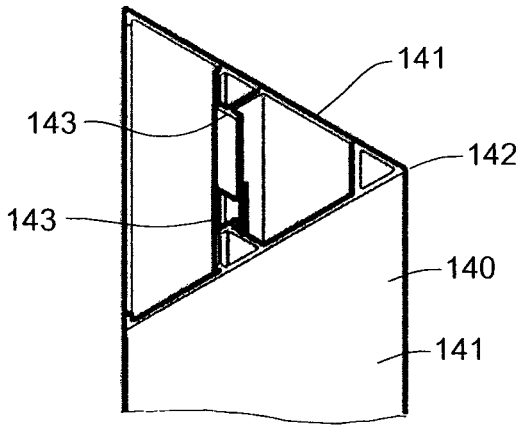
FIG. 25 is an enlarged fragmentary perspective view of the two-way trim cover.

As to FIG. 23, this illustrates a right-angled two-way connection generally corresponding to FIG. 14 thereof. For a specific right-angle, two-way corner connection, the corner block would have a pair of spacers 105 between each of the vertical frame rails 16 and three light blocks 44 adjacent to each panel frame rail 16. For the remaining fourth corner portion 98 of the corner block 41, the remaining fourth mounting slot 99 would remain empty. Additionally, the spacers 105 on the open sides of the corner block are removed as indicated by reference arrows 108 in FIG. 23. For this right-angle corner connection, FIGS. 24 and 25 illustrate a generally L-shaped right angle trim cover 140 which has trim faces 141 joined together integrally at an intermediate corner 142. The upper end of the trim cover 140 is provided with two upper mounting flanges 143 formed the same as the above-described mounting flange 129 which mounting flanges 143 slide downwardly into the corresponding support slots 90 located in the corner block 41 as indicated by reference arrow 144 in FIG. 24 and has additional mounting flanges 143 which secure to lower corner blocks 41. As such, this right-angle trim cover 140 encloses the two open sides of this corner connection.

Figure 27:
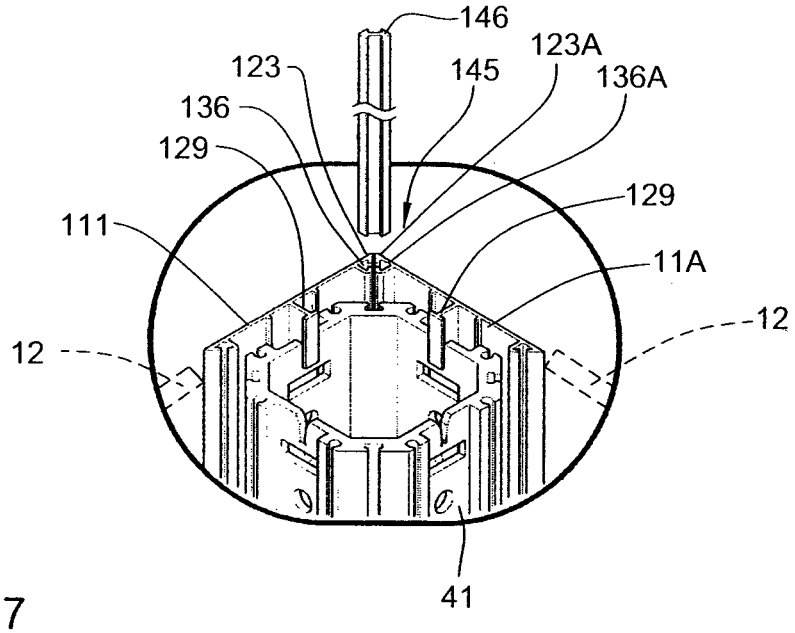
FIG. 27 is an enlarged fragmentary perspective view illustrating a corner spline being inserted into and joining two single-side trim covers together.
Figure 28:
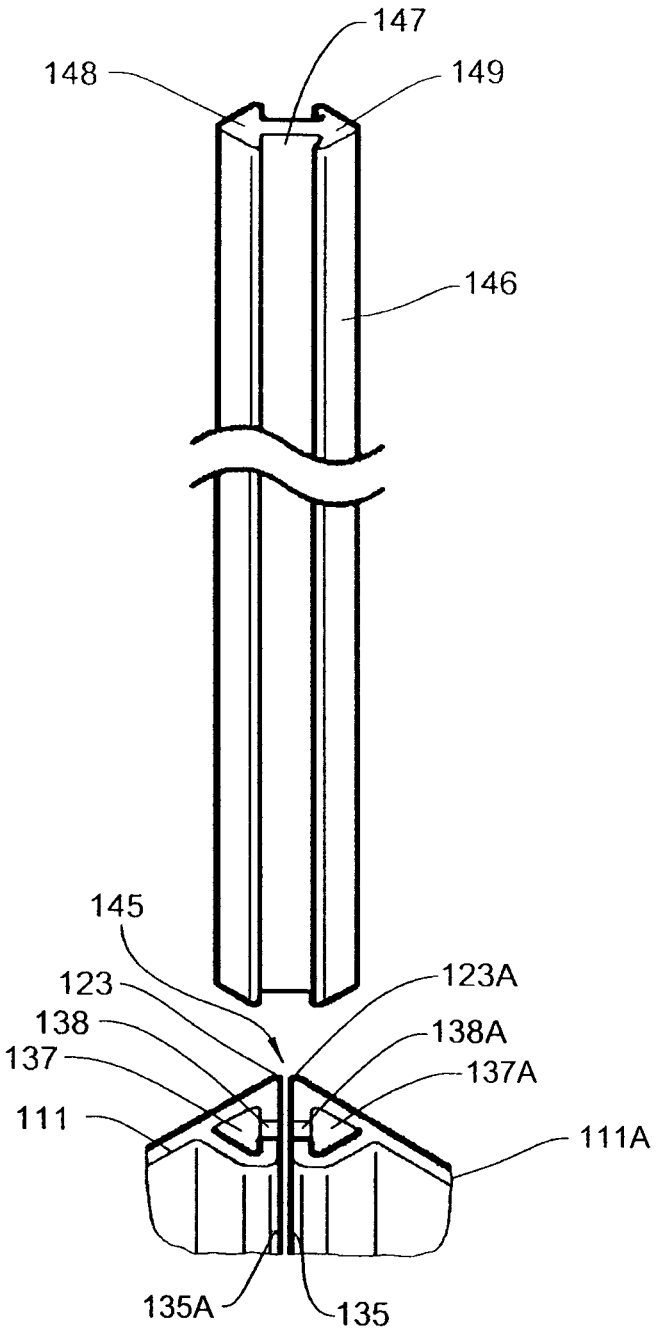
FIG. 28 is an enlarged partial perspective view illustrating the spline and corner connector structure of the trim covers.

Also as seen in FIGS. 27 and 28, along the edges 123 of the trim cover 122, these edges 123 include corner faces 135 which are oriented at a 45° angle relative to the main trim cover face 122. In these corner regions, connector slots 136 are provided which are defined by triangular slot portions 137 and a narrow slot mouth 138 which extends along the vertical length of the trim cover 111 and opens inwardly therefrom.

Figure 26:
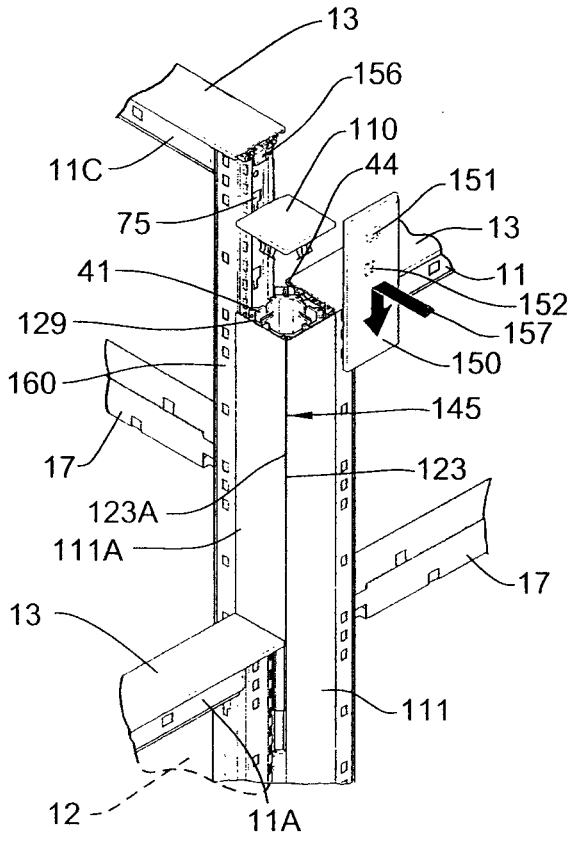
FIG. 26 is a partial perspective view of a multi-height, three-way corner connection.
Figure 29:
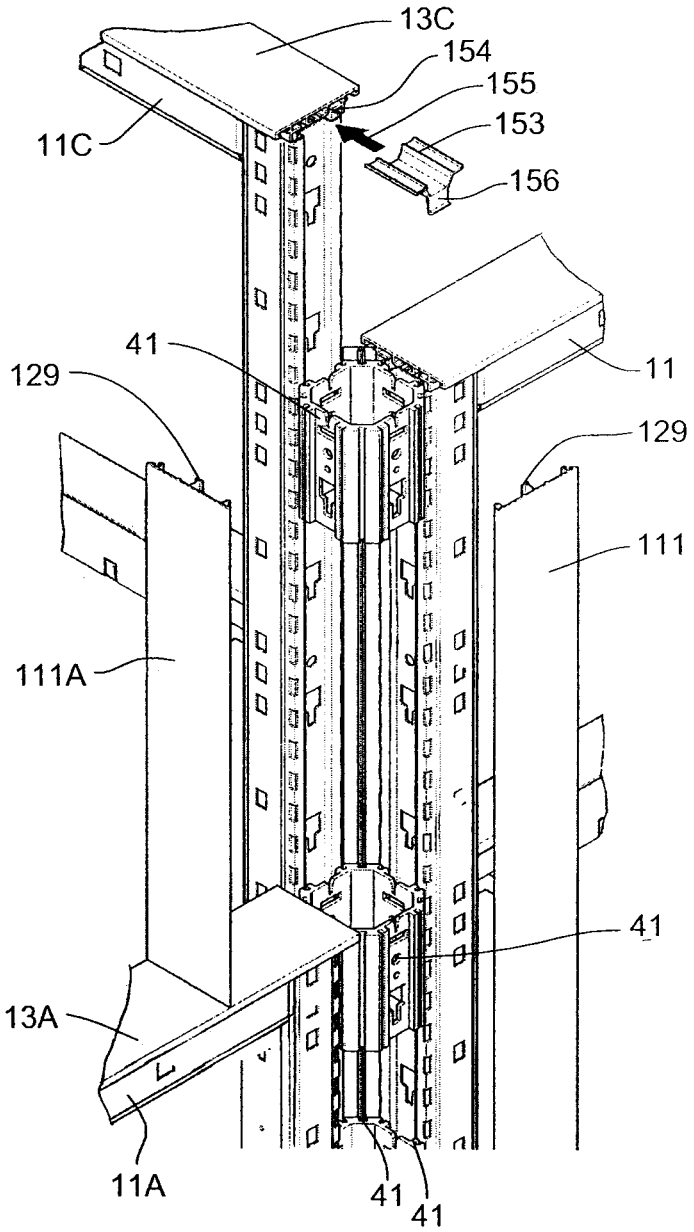
FIG. 29 is an exploded view of the multi-height, three-way corner connection.
Figure 30:
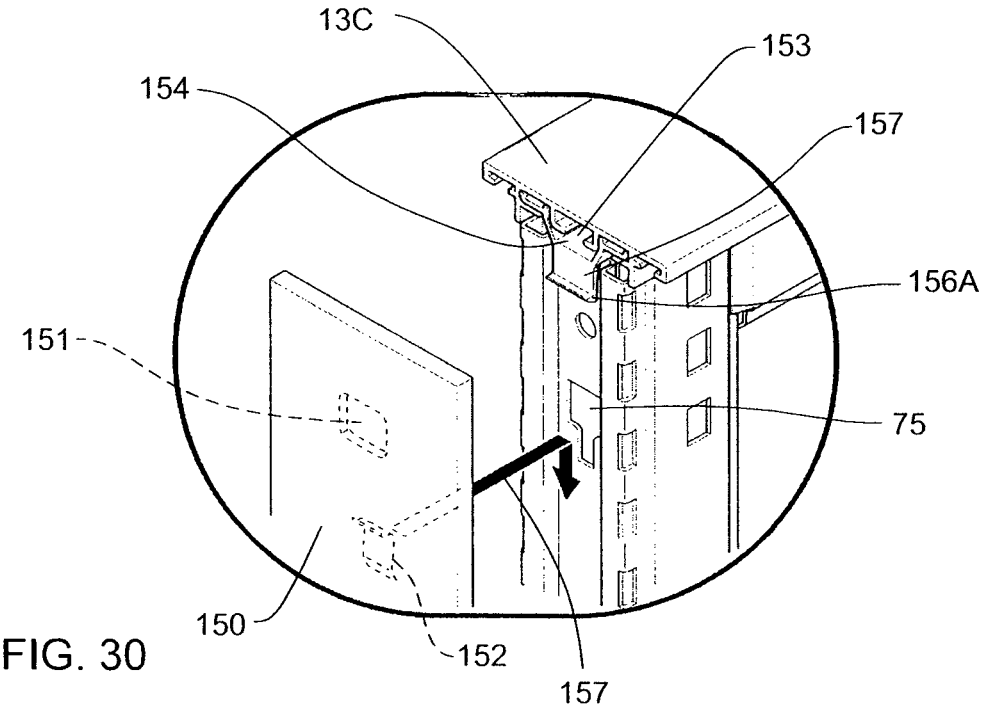
FIG. 30 is an enlarged partial perspective view illustrating an end-of-run trim cover being mounted to a panel frame and associated top cap.

With respect to the corner system of the invention, the above-described components also are readily usable for variable-height corner connections such as the variable-height, three-way corner connection illustrated in FIGS. 26 and 29. For this corner connection, panel frames 11, 11A and 11C are joined together even though all of such frames have different heights one relative to the other. In this manner, the corner blocks 41 are positioned in the various patterns illustrated in FIG. 7 and bolted to the respective panel frames 11, 11A or 11C through the bolts 42 in the manner as previously described herein. For the longest open side of this corner connection, the above-described trim cover 111 is mounted to the top corner block 41 and encloses this open side.

Due to the variable heights of the panel frames, however, the side of the corner connection vertically between the panel frames 11A and 11 is open due to the different heights. To enclose this side, a single-side trim cover 111A is provided which is formed the same as trim cover 111 but has a shorter vertical length corresponding to the vertical distance between the top face of the top cap 13 located on frame 11A and a short distance above the uppermost corner block 41 seen exposed in FIG. 26. This trim cover 111A also has mounting flanges 129 for mounting to the corner blocks 41 as seen in FIGS. 26 and 27. To close the corner joint 145 that is defined between the adjacent corners 123 and 123A, the structure of the invention is configured so that a connector spline 146 may be fitted into the corner mounting slots 136 and 136A of the respective trim covers.

As seen in further detail in FIG. 28, this connector spline 146 has a center web 147 and triangular shaped ribs 148 and 149 which extend along the entire vertical length of the spline 146. Each of these triangular connector portions or ribs 148 and 149 respectively corresponds to the triangular shape of the large slot portion 137 and 137A of the respective trim covers while the spline web 147 extends through the narrow slot mouthes 138 and 138A to not only structurally join the trim cover corner portions 123 and 123A together but also close off this vertical joint 145 to define a closed corner. At this right angle corner connection it is noted that the corner faces 135A and 135 of their respective trim covers abut together in facing relation to define this 90° corner. Any combination of lengths of the trim covers 111 and 111A may be readily joined together by an appropriate spline 146 which extends along the length of the vertical joint 145 formed between the adjacent trim covers to further improve the finished appearance of such components.

To further complete the finished appearance of the multi-height corner connection of FIG. 26, an end of run trim cover 150 is provided which has a generally rectangular shape and is formed with a support pocket 151 on the inside base thereof as well as a resilient spring clip or connector clip 152 which projects inwardly and is adapted to extend through an appropriate T-opening 75 in the vertical frame rail 16C. More particularly, as seen in FIG. 29, a support clip 153 is provided which fits into an open ended slot 154 formed in the top cap 13C which insertion is indicated by reference arrow 155. When fully inserted, a support leg 156 projects downwardly as seen in FIG. 26. To mount the end of one trim cover in position, the trim cover 150 is shifted sidewardly and then downwardly as indicated by reference arrow 157 wherein the support pocket 151 fits onto a ledge 156A formed on the end of the clip leg 156 with the above-described spring clip 152 being fitted into the T-opening 75 and then gripping the adjacent wall thickness of the vertical frame rail 16C. This positions and supports the end of one trim cover 150 directly above the corner cap 110.

Figure 31:
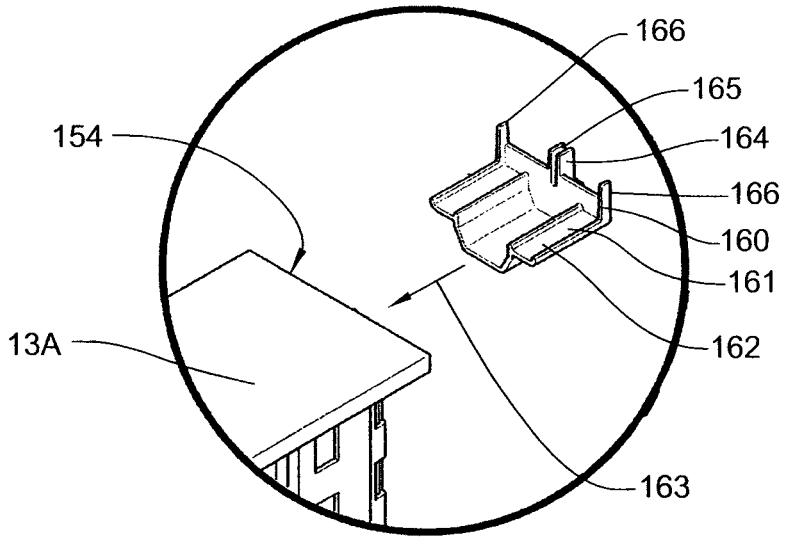
FIG. 31 is an enlarged partial perspective view illustrating a locator clip for the bottom of a short trim cover used for 3-way variable height corner connections or at an end of run.

Referring to FIG. 31, an additional support clip 160 is provided to secure the lower end of the short trim cover 111A. In particular, this clip 160 includes an insert portion 161 which fits into the above-described slot 154 that is located below top cap 13A. The slot 154 is the same structure and shape as the above-described slot formed in the top cap 13C. Mounting of the clip 160 is accomplished by inserting the main clip body 162 sidewardly as indicated by reference arrow 163 into the slot 154. An exterior portion 164 of the clip includes an upward opening slot 165 and fingers 166. The slot 165 is adapted to receive a corresponding mounting flange 129 on the bottom edge of the trim cover 111A to maintain the lower trim cover in position relative to the top cap 13A and the remainder of the system components.

With the above-described arrangement, a variety of corner configurations can be readily accommodated even with the provision of variable height panel frames.

Although particular preferred embodiments of the invention have been disclosed in detail for illustrative purposes, it will be recognized that variations or modifications of the disclosed apparatus, including the rearrangement of parts, lie within the scope of the present invention.

The invention claimed is:

1. A wall panel system comprising:

a plurality of wall panels each having an inner frame having opposite sidewalls and opposite ends defining a width between said sidewalls and having at least one side cover having lateral ends and an outer surface attached to and covering at least one of said sidewalls of said frame and defining a planar panel face of said wall panels;

at least one corner block having a plurality of block sides, at least two of said block sides adapted to connect one of said ends of one of said frames thereto and permitting the interconnection of said ends of at least two of said frames together;

wherein said corner block includes four angled block corners which are each defined between an adjacent pair of said block sides, said block corners having a width extending between adjacent block sides, each block corner including a light block slot arrangement;

an elongate light block having an interior surface and an exterior surface, said light block mounted to said light block slot arrangement and disposed between said lateral ends of adjacent side covers such that said exterior surface of said light block is disposed interior of said outer surfaces of adjacent side covers, and said interior surface of said light block abuts said angled block corner; and at least one fastener connecting said at least one corner block to said at least two frames.

2. The wall panel system of claim 1 wherein said plurality of block sides permit the interconnection of adjacent said frame ends of at least two of said panel frames together in serially-adjacent relation to define a multi-way connection wherein said frames are mountable on opposite said block sides in an inline configuration and mountable on adjacent said block sides in an angled configuration, any unused block sides of said block sides which remain unused defining a space between the adjacent panel faces of said panels.

3. The wall panel system of claim 2 including at least one trim cover adapted to mount to said corner block on any of said unused block sides which are unused after the connection of said plurality of said frames, said trim cover having an outer trim face.

4. The wall panel system of claim 3, wherein said light block is a vertically elongate strip having a length extending along the vertical height of at least one of said panels and a width spanning said width of said block corner.

5. The wall panel system of claim 4 including at least one spacer disposed between each of said block sides and said frame ends connected thereto, said spacer including opposing surfaces, said block sides and said frame ends being spaced apart from each other across the entirety of said frame end width such that said frame ends and said corner block are each in contact with one of said opposing surfaces of said spacer but not in direct contact with each other.

6. The wall panel system according to claim 1, wherein said at least one corner block includes at least two slots in each of said block sides and said slots are adapted to mount at least a pair of spacers to each said block side to space a respective said panel frame from said block side.

7. The wall panel system of claim 6 wherein said pair of spacers includes a spacer arrangement that includes a first spacer pairing between said corner block and one of said frame ends and a second spacer pairing between said corner block and another of said frame ends.

8. The wall panel system of claim 7 wherein said at least one corner block includes first and second vertically spaced apart corner blocks.

9. A wall panel system comprising:

first and second wall panels each including a frame having opposing sidewalls and end portions defining a width between said sidewalls;

a plurality of cover panels having lateral ends and outer surfaces, each of said sidewalls having at least one of said cover panels attached thereto;

a corner block connectable to said first and second wall panels in an angled configuration wherein said first wall panel is arranged at an angle with respect to said second wall panel, said corner block including a first corner block sidewall facing said first wall panel end portion, a second corner block sidewall facing the second wall panel end portion, and an angled block corner having a width extending between said first corner block sidewall and said second corner block sidewall at an angle with respect to said first corner block sidewall and said second corner block sidewall;

an elongate light block having an interior surface and an exterior surface, said light block mounted to said angled block corner, said elongate light block spanning said width of said angled block corner and disposed between said lateral ends of adjacent cover panels such that said exterior surface of said light block is disposed interior of said outer surfaces of adjacent cover panels, and said interior surface of said light block abuts said angled block corner; and at least one fastener connecting said at least one corner block to said first and second wall panel end portions, wherein interior corners are defined at a joint between said first and second wall panels in said angled configuration, said elongate light block mounted to said angled block corner interiorly of said joint at said interior corner.

10. The wall panel system of claim 9 wherein said corner block is a first corner block and further including a second corner block interposed between the first and second wall panels.

11. The wall panel system of claim 10 wherein said first corner block and said second corner block are vertically spaced apart from one another.

12. The wall panel system of claim 11 wherein said elongate light block vertically spans at least said first corner block and said second corner block.

13. The wall panel system of claim 12 wherein said angled block corner defines a slot, a portion of said elongate light block extending into said slot for mounting said light block on said angled block corner.

14. The wall panel system of claim 13 further including a trim cover mountable to a corner block sidewall that is not connected to one of said frame end portions.

15. A wall panel system comprising:

a wall panel including a frame having opposing sidewalls and lateral end portions defining a width between said sidewalls, each of said lateral end portions defining a vertical centerline at the midpoint between the sidewalls, the wall panel including at least one cover panel having lateral ends and an outer surface, the wall panel attached to and covering at least one of the sidewalls of the frame;

a corner block connectable to the wall panel, the corner block including a first sidewall facing the wall panel end portion, the first sidewall including a recessed portion and thicker portions, the recessed portion disposed between the thicker portions, the recessed portion spaced from the wall panel end portion and defining at least one fastener hole, the corner block including a second one of the sidewalls adjacent the first sidewall, and an angled corner section disposed between the first and second sidewalls;

at least one elongate light block having an interior surface and an exterior surface, the light block attached to the angled corner section of the corner block, the elongate light block disposed between the lateral ends of adjacent cover panels such that the exterior surface of the light block is disposed interior of the outer surfaces of adjacent cover panels, and the interior surface of the light block abuts the angled corner section;

at least one spacer disposed between the corner block first or second sidewall and the wall panel end portion connected thereto, the at least one spacer is positioned between one of the thicker portions of the corner block first or second sidewall and the wall panel end portion; and at least one fastener extending through the at least one fastener hole and connecting the corner block to the wall panel.

16. The wall panel system of claim 15 wherein the spacer includes opposing surfaces, the corner block sidewall and the wall panel end portion being spaced apart from each other across the entirety of the width of the wall panel end portion such that the wall panel end portion and the corner block are each in contact with one of said opposing surfaces of said spacer but not in direct contact with each other.

17. The wall panel system of claim 16 wherein the corner block is a first corner block and further including a second corner block connected to the wall panel and vertically spaced from the first corner block.

18. The wall panel system of claim 17 further including a trim cover mountable to one of the sidewalls of the corner block that is not attached to a wall panel end portion.

* * * * *